US008479934B2

(12) United States Patent
Brown et al.

(10) Patent No.: US 8,479,934 B2
(45) Date of Patent: Jul. 9, 2013

(54) BOTTLE DESIGN WITH MULTIPLE SEALS

(75) Inventors: Craig E. Brown, Mt. Zion, IL (US); Robert J. Brown, Chesterfield, MO (US)

(73) Assignee: New Vent Designs, Inc. Delaware Corp., Mount Zion, IL (US)

( * ) Notice: Subject to any disclaimer, the term of this patent is extended or adjusted under 35 U.S.C. 154(b) by 854 days.

(21) Appl. No.: 12/291,749

(22) Filed: Nov. 13, 2008

(65) Prior Publication Data

US 2009/0127220 A1 May 21, 2009

Related U.S. Application Data

(60) Provisional application No. 61/003,635, filed on Nov. 19, 2007.

(51) Int. Cl.
*A61J 9/04* (2006.01)

(52) U.S. Cl.
USPC ..... 215/11.1; 215/11.5

(58) Field of Classification Search
USPC ..... 215/11.1, 11.5, 11.4
See application file for complete search history.

(56) References Cited

U.S. PATENT DOCUMENTS

| | | | | |
|---|---|---|---|---|
| 189,691 | A | 4/1877 | Briere | |
| 345,518 | A | 7/1886 | Lelievre | |
| 598,231 | A | 2/1898 | Roderick | |
| 679,144 | A | 7/1901 | Hardesty | |
| 834,014 | A | 10/1906 | Lyke | |
| 927,013 | A | 7/1909 | Van Cleave | |
| 1,441,623 | A | 1/1923 | Davenport | |
| 1,600,804 | A | 9/1926 | Donaldson | |
| 2,061,477 | A | 11/1936 | Perry | |
| 2,156,313 | A | 5/1939 | Schwab | |
| 2,239,275 | A | 4/1941 | Schwab | |
| 2,610,755 | A | 9/1952 | Gits | |
| 2,742,168 | A | 4/1956 | Panetti | |
| 2,744,696 | A | 5/1956 | Blackstone | |
| 3,059,707 | A | 10/1962 | Wilkerson et al. | |
| 5,570,796 | A | 11/1996 | Brown et al. | |
| 5,779,071 | A | 7/1998 | Brown et al. | |
| 6,257,429 | B1 * | 7/2001 | Kong | 215/11.3 |
| 6,679,395 | B1 * | 1/2004 | Pfefferkorn et al. | 215/307 |
| D544,833 | S | 6/2007 | Sade et al. | |
| 2004/0188373 | A1 * | 9/2004 | Lewis et al. | 215/11.5 |
| 2005/0258124 | A1 * | 11/2005 | Brown et al. | 215/11.1 |
| 2009/0127220 | A1 | 5/2009 | Brown et al. | |

FOREIGN PATENT DOCUMENTS

| | | |
|---|---|---|
| GB | 273185 | 6/1927 |
| GB | 454053 | 9/1936 |

* cited by examiner

*Primary Examiner* — J. Gregory Pickett
*Assistant Examiner* — Robert Poon
(74) *Attorney, Agent, or Firm* — Paul M. Denk

(57) ABSTRACT

A nursing bottle formed of a container, incorporates a reservoir and venting tube that eliminates vacuum. The nursing bottle has a cylindrical shape or other configuration that prevents formula therein from blocking the venting tube when held at any angle. The venting tube extends distally from the insert and alternatively may be in separate pieces. The insert has a flange on its perimeter, extending inferiorly and securing the insert to the superior and lateral aspects of the neck of the container. The vent opens at the volumetric center of the reservoir above the conically shaped venting tube depending from the reservoir, where the venting tube has a conical shape of decreasing diameter.

6 Claims, 17 Drawing Sheets

BOTTLE DESIGN WITH MULTIPLE SEALS

CROSS REFERENCE TO RELATED APPLICATION

This regular letters application for patent claims priority to the provisional patent application having Ser. No. 61/003,635, which was filed on Nov. 19, 2007; the non-provisional patent application Ser. No. 11/258,966, which was filed on Oct. 25, 2005, as a continuation of the non-provisional patent application having Ser. No. 10/283,878, which was filed on Oct. 30, 2002, and which was filed during the pendency of PCT application Serial No. US2001/014,365, which was filed on May 4, 2001, designating the U.S. and which claimed priority to U.S. provisional application Ser. No. 60/202,851 filed on May 8, 2000.

This provisional application for patent also claims priority to the non-provisional patent application Ser. No. 11/152,320, which was filed on Jun. 14, 2005.

BACKGROUND OF THE INVENTION

The bottle design with an insert having multiple seals relates generally to infant serving products. More specifically, the present invention refers to nursing bottles having an internal venting tube that prevents a vacuum within the bottle and assists any infant, including a premature infant, to suck liquid from the bottle.

A unique aspect of the present invention is a vent insert with an exterior flange that descends upon the outside of the neck of a container and further prevents leakage from the container. The invention has a second seal formed by a flange on the inferior and lateral aspect of the insert, descending inferiorly and mating with a press fit to the lateral diameter of the neck of the feeding container, which also prevents leaks from the container. The present invention also includes a reservoir which is less than the inside diameter of the neck of the bottle. Preferably, at least one annular projection from the inferior aspect of the insert mates with the reservoir in a press fit which allows for reuse of the reservoir or disposal of the venting assembly. In an alternate embodiment, the diameter of the reservoir is the same as the inside diameter of the neck of the bottle and the reservoir is especially designed with at least two lengthwise flutes for passage of feeding liquid from the bottle through the vent insert and on to the nipple. Additionally, the reservoir may secure to the inferior surfaces of the insert by many methods including sonic welding, spin welding, solvent welding, and the like. The reservoir and vent insert may occupy the opening of the feeding container and the entire venting mechanism provides for full venting during usage.

Newborns and older infants are in need of sustenance in the form of calories, hydration, vitamins, and minerals. Initially, infants require feeding every two to four hours. Traditionally, breast-feeding has supplied the aforementioned sustenance. However, at times, breast milk is inadequate or does not appear. Also, other factors may interfere with the infant receiving adequate hydration and nutrition: being premature, having anatomical issues, such as a cleft lip or palate, or having developmental issues that preclude adequate breast feeding.

For a variety of reasons, babies drink liquids from other sources but, babies lack the ability to drink from ordinary cups. So, liquids are fed to babies using baby, or nursing, bottles. A traditional bottle features a flexible nipple with a hole in its tip secured across an opening in the top of a nursing bottle. The current nursing bottle of the applicants is used by filling the bottle with a liquid, inserting the venting structure, securing the nipple onto the insert resting upon the neck of the bottle, inverting the bottle, and placing the nipple into the baby's mouth for suckling.

Early on, inventors created closed containers to assist feeding infants, a container with a pliable end that was nipple shaped. With this arrangement, significant negative pressure instantly builds within the interior of the container similar to the pressure in the middle ear failing to equalize as the pressure decreases within an airplane, causing ear pain. In a baby bottle, this large vacuum requires a larger negative pressure to withdraw the feeding liquid form the bottle, basically identical to the pressure when the infant sucks on its thumb or pacifier. All of these pressures contribute to the formation of ear fluid, ear infections, speech and motor delays, and delayed cognitive development.

The prior art then introduced a slit, or defect, in the feeding nipple, to allow air to enter the container as the negative pressure accumulates. This adaptation slowly and partially vents the vacuum in the bottle while the infant feeds and still exposes the infant to the detrimental effects of negative pressure. This prior art adaptation also contaminates the feeding liquid as air percolates through the feeding liquid that the infant then swallows and is known to cause colic, fussiness, reflux, and gas induced abdominal pain.

Currently, other nursing bottles, except those by the inventors, are tightly sealed but for the opening in the feeding end of the nipple and the venting slot, or hole, in the flange of the nipple, the bottom of the container, or other locations. In bottles, except those by the inventors, as the baby nurses, the volume of liquid in the bottle decreases and the vacuum increases proportionally. However, this invention and the other patented devices of the inventors use vent tubes that allow ambient air to enter the bottle behind the liquid while the baby suckles. This venting structure continuously and automatically eliminates any vacuum within the bottle created by the suckling baby. The vent tube improves the flow of liquid out of the nipple and makes it easier for the baby to suckle with less risk of ingesting air and the resulting colic.

The negative pressures, or vacuums, in the containers by others previously described and the air introduced into them are mechanical shortcomings that cause significant infant morbidity. It is well known that breast feeding involves a positive pressure within the breast as measured by canulas inserted into the ducts of the breast.

Infant feeding containers originally had a narrow superior orifice to which the nipple was attached. Caregivers noted that the narrow opening prevented ready access to the interior of the bottle and prevented easy cleaning of the interior of the bottle. Manufacturers then made bottles having larger openings.

The larger openings called for nipples and feeding spouts with larger diameter flanges to mate with the opening of a bottle. The larger diameter flanges prevented leaks where the nipples joined to the bottles but, have a larger volume of air contained by the nipples.

Further, infants often chew upon nipples, designed for suckling to remove fluid from a container. Nipples and other feeding accessories therefore have chew resistant designs. Chewing of nipples arises more often in infants with feeding problems, such as neurological delays or deficits, and frequent chewing motion upon objects placed in the mouth, often nipples.

During frequent chewing on a feeding nipple upon a wide neck large volume container, the infant compresses this air, distally, or into the bottle, thereby increasing the pressure upon the interior of the bottle. The increased pressure may force liquid distally into a venting tube located within the bottle. The pressurized liquid possibly traverses the vent tube—if it is cylindrical and not conical—and may enter the vent insert, and then possibly leaks from the bottle. The pressurized liquid can only occur when using larger diameter nipples in combination with reservoirs that utilize straight cylindrical venting tubes. Further, when a cylindrical vent tube is replaced with a conical vent tube, the liquid can no longer be propelled up the vent tube as an infant compresses the large volumetric nipple.

Other applications requiring fluid distribution without the antagonistic effects of a vacuum and without air contamination of the liquid can benefit from a fully vented container which provides for the egress of fluid at a desired rate.

Feeding containers using collapsible bags are messy, expensive, and provide a negative feeding pressure in the last two ounces of feeding liquid. A feeding container from Offman, with a vent in the side of the neck of the bottle, prevents cleaning and its reservoir leaks when the venting mechanism is oriented downwardly and as the infant instinctually compresses the nipple which is necessary for feeding. Previously, the Applicants introduced a container using a venting tube and reservoir formed in two pieces. The Applicants' prior inventions consist of a feeding container and a venting mechanism that provides for full and continuous venting, without leaks, and without percolation of air through the feeding liquid.

Others have attempted to provide a nursing bottle with an air vent to reduce the creation of a vacuum during suckling. An early patent to Roderick, U.S. Pat. No. 598,231 has a nursing bottle with a U shaped tube. However, the average baby, upon uplifting a bottle, had some liquid retained in the U shaped tube that blocked the tube and prevented release of vacuum within the bottle. Other patents show related technology for venting air from the interior of a container, in the U.S. patent to Van Cleave, U.S. Pat. No. 927,013. In addition, the patents to Davenport, U.S. Pat. No. 1,441,623 and to Perry, U.S. Pat. No. 2,061,477, show other means for venting air from within a nursing bottle.

In the preceding work of these applicants, U.S. Pat. Nos. 5,779,071 and 5,570,796, venting and internal tubes prevent the formation of partial vacuums during suckling and also resist spills. The '071 patent provides a venting tube that extends into a bottle and a reservoir and has a hollow cylindrical shape projecting downwardly into the bottle. The '796 patent provides a reservoir located above a mark on the bottle. The reservoir communicates with a conduit system to replace suckled liquid with air from outside the feeding container by allowing air to enter through the reservoir to the bottom of the container, thus preventing a partial vacuum in the bottle when in the feeding position. Nursing bottles of a multitude of designs are available in the prior art and except for the patented devices of the applicants, a vacuum will be generated within these bottles when suckled by an infant. A vacuum is known to cause various physiological impairments to the infant when subjected to this type of condition. The vacuum within the bottle, due to the infant's sucking, can cause pressure imbalance in various parts of the body, such as in the ear canal which may accumulate fluid, and cause ear infections, speech delay, motor delay, developmental delay, illness, and other impairments. Thus, a nursing bottle that incorporates air venting means, to prevent the creation of a vacuum inside the bottle, has been desirable for infant serving products. Such can be seen in the inventors' prior patents '071 and '769, when the feeding bottle is inverted, or in the feeding position, external air enters, into the insert, into the reservoir, through the venting tube to the bottom of the bottle, thereby completely eliminating all vacuum within the bottle and air bubbles previously ingested by the infant.

The current invention vents any vacuum within any feeding, or other container, angled, straight, wide neck or other shape, and prevents any vacuum or pressure therein, regardless of whether the nursing bottle is being used when partially or fully inverted.

Other U.S. patents that relate to the subject matter of this invention include the U.S. patent to Briere, U.S. Pat. No. 189,691; U.S. Pat. No. 345,518 to Lelievre; U.S. Pat. No. 679,144 to Hardesty; U.S. Pat. No. 834,014 to Lyke; U.S. Pat. No. 1,600,804 to Donaldson; U.S. Pat. No. 2,156,313 and U.S. Pat. No. 2,239,275 to Schwab; U.S. Pat. No. 2,610,755 to Gits; U.S. Pat. No. 2,742,168 to Panetti; U.S. Pat. No. 2,744,696 to Blackstone; U.S. Pat. No. 3,059,707 to Wilkinson, et al.; and U.S. Pat. No. 5,570,796 to Brown, et al. In addition, British patents No. 273,185 and No. 454,053 show related developments.

The prior art containers have suffered from significant disadvantages, except for the inventions of the Applicants. Such disadvantages include:

1. The formation of vacuums that prevent oral feeding by infants with cerebral palsy, cleft lip, cleft palate, and other feeding difficulties.

2. The formation of vacuum within a container that delays premature infants from going home when they have a poor sucking reflex or require weaning from a feeding tube.

3. The formation of vacuum within a container that suppresses close bonding contact between caregivers and premature infants that have a poor sucking reflex or require weaning from a feeding tube.

4. The formation of vacuum within a container that prolongs hospitalization and increases costs for premature infants that have a poor sucking reflex or require weaning from a feeding tube.

5. Manufacturing for prior art containers has a high cost for the container, vent parts, and collapsible bags.

6. Reusable feeding containers incur sterilization and handling costs.

7. In a hospital with many infants in one location and because of government regulations, costly bottles, not intended for disposal, are used and then disposed after each feeding.

8. As infants require multiple feedings daily, repeated use of prior art feeding containers increases the incidence of an infant receiving a feeding container previously used by another well or ill infant.

9. Because hospital staff, including nurses, reuse a small number of containers and keep each infant on the same type of container first used by that infant, the incidence rises of an infant receiving a feeding container previously used by another well or ill infant.

10. Also, the parents of an infant will likely reuse containers and keep their infant on the same container that the infant likes, which increases the incidence of their infant receiving a feeding container previously used in a hospital nursery by another well or ill infant.

11. Often, ill infants with varying severity of illness, require hourly feedings which increases the possibility of contamination when non-disposable containers are reused.

12. The prior art bottles, except those of the applicants, do not provide an internal vent system and mechanism for containing fluids which keeps the air vent ports clear of feeding liquid. Therefore, the prior art bottles often leak.

13. Parents, hospital staff, nurses, and relatives report that leakage occurs from vent holes in prior art bottles, except those of the applicants.

14. When prior art bottles release feeding liquid, a vacuum, or negative pressure, occurs in non-vented or partially vented bottles, in contrast to the present invention and the prior patents of the applicants.

15. The vacuum in prior art bottles, except those by the applicants, induces a vacuum in the intra-oral cavity of an infant which spreads into the ears and leads to accumulation of ear fluid, ear infections, speech and motor delays, and cognitive delay among other unhealthy maladies.

16. Prior art bottles, except those of the applicants, cause a vacuum and have an irregular release of the feeding liquid.

17. Vacuum formation in prior art bottles, except those of the applicants, prevents an infant from feeding on demand, the preferred method.

18. Frequently, prior art bottles, except those of the applicants, introduce air into the feeding liquid that an infant ingests. The ingested air contributes to colic, irritability, fussiness, and abdominal gas pain.

19. Further, vacuum formation prevents the use of a feeding liquid container without a positive pressure liquid source, powered by a pump, to overcome the negative pressure within prior art bottles, except those of the applicants. Such pumps burden parents and hospital staff with mechanical devices and higher costs.

20. To overcome the vacuum in prior art bottles, except those of the applicants, the body of the fluid filled container has a vent hole. The vent hole, creates a void where feeding liquid readily escapes, or leaks, and contaminates the immediate area and decreases the amount of feeding liquid in the container.

21. In prior art bottles, except those of the applicants, precise release of feeding liquid has proven difficult due to the gradual rise of the negative pressure.

22. Additionally, vent holes in prior art containers, except those of the applicants, foster contamination of feeding liquid by bacterial growth.

23. Further, the prior art requires the usage of specially designed and expensive materials for disposable parts of the container, such as bags, or expensive materials for durable parts of the container, such as diaphragms.

24. The prior art bottles call for a slightly longer period of time for the venting mechanism to clear itself of liquids.

25. The prior art has a single seal between the insert and the container to prevent leakage therefrom.

The present art overcomes the limitations of the prior art, that is bottles that vent through a void in the flange of the nipple and a need exists for eliminating vacuum inside nursing bottles. That is, the art of the present invention, a bottle design with an overlapping insert forming two seals prevents leaks at the neck of the bottle and allows liquid to flow readily around a reservoir thus eliminating the formation of a vacuum within a nursing bottle. The enlarged proximal portion of the vent tube minimizes the incidence of leakage from the bottle. The present invention cleans easily, and dissipates pressure generated by chewing. The present invention prevents leaks, and immediately and continuously vents a bottle, by eliminating any air bubbles in the vent tube.

Additionally, the present invention presents the following advantages:

1. The elimination of vacuums fosters oral feeding by infants with cerebral palsy, cleft palate, and other feeding difficulties.

2. The elimination of a vacuum within a container reduces the time necessary before premature infants go home as their sucking reflex strengthens as they wean quicker from a feeding tube.

3. The elimination of vacuum within a container fosters close bonding contact between caregivers and premature infants that have a poor sucking reflex or require weaning from a feeding tube.

4. The elimination of vacuum within a container shortens hospitalization and reduces costs for premature infants weaned more quickly from a feeding tube.

5. Manufacturing for the present invention has a low cost for the container, the vent parts, and other components.

6. The components of the present invention are disposable if desired.

7. Where infants receive care in groups, the inexpensive, container of the present invention can be discarded following each feeding.

8. As infants require multiple feedings per day, the low cost present invention can be discarded, which decreases the incidence of an infant receiving a feeding container previously used by another infant or an ill infant.

9. As hospital staff and nurses have a small number of containers, the present invention allows use of any type of formula.

10. The parents of an infant, who likely have a limited number of containers, can keep their infant on its preferred container, which decreases the incidence of an infant receiving a feeding container previously used by another infant or an ill infant.

11. The present invention, a durable item, may be re-used if desired. Alternatively if the present invention is disposed, the incidence decreases of an infant receiving a feeding container previously used by another infant or an ill infant.

12. Often, ill infants, require feedings multiple times per hour which is supported by the disposable feature of the present invention and thus decreases contamination by reuse of bottles.

13. An internal vent system and mechanism for containing fluids in the present invention keeps the air vent ports clear of feeding liquid regardless of the position of the container.

14. Parents, hospital staff, nurses, and relatives will benefit from a marked reduction in leaks from bottles as the present invention has no need to use vent holes.

15. When the present invention releases feeding liquid, no vacuum, or negative pressure occurs.

16. The lack of a vacuum within the present invention prevents the existence of a vacuum in the intra-oral cavity of an infant which decreases the incidence of accumulation of ear fluid, ear infections, speech and motor delays, and cognitive delay among other maladies.

17. The present invention has regular release of the feeding liquid to the infant as a result of the absence of a vacuum.

18. The present invention encourages an infant to feed on demand, the preferred method of feeding.

19. The present invention does not introduce air into the feeding liquid that gets consumed by an infant and therefore greatly reduces the possibility of colic, irritability, fussiness, and abdominal gas pain.

20. Further, no pump is required by the present invention as no vacuum has to be overcome, thus lowering the cost burden on parents and hospital staff.

21. The present invention has no vent holes through which feeding liquid could leak, contaminate the immediate area, and also decrease the amount of feeding liquid remaining in the container.

22. The present invention provides for precise release of feeding liquid due to the constant positive pressure.

23. The present invention has no holes in the wall of the container as in several prior art containers, thereby making the container easier to clean and reducing the contamination of the feeding liquid with air and bacteria.

24. Further, the present invention does not require the usage of expensive materials to ensure completely sealed mating of a reservoir to an insert, an insert to a bottle, or expensive materials for disposable parts of the container, such as bags, or expensive materials for durable parts of the container, such as diaphragms.

25. The present invention has a shorter period of time for the venting mechanism to clear itself of liquids.

26. The present invention uses two seals between the insert and the container to prevent leakage therefrom.

The present invention with the advantages described and avoiding the disadvantages of the prior art containers by others provides infants and their care givers a container for feeding liquid with virtually no leaks, no vacuum, and little, if any, air ingested by the infant.

SUMMARY OF THE INVENTION

Previously, infant feeding bottles, except those of the inventors, had a non-vented, or partially vented, container with the previously described disadvantages. The cost of prior art bottles did not allow for easy disposal. The prior art bottles also served poorly in hospitals where they were not physiological and posed health risks that typically increased infant morbidity.

The present invention provides for an economical container that permits full and continuous venting of a container of feeding liquid, and that completely eliminates formation of vacuum with the container. The present invention allows for the ready flow of feeding liquid as demanded by the infant without leaks from the container or the mixing of air within the feeding liquid. The present invention provides a feeding container that fosters normal oral, ear, respiratory, and digestive physiology; and encourages hygienic nutrition along with optimizing the feeding abilities of all infants.

Accordingly, the present invention improves the venting insert and reservoir within a nursing bottle by extending a lateral inferiorly directed flange downwardly forming a second seal over the exterior surface of the neck, a tapered tube depending from the reservoir, and at least one projection upon the inferior surface of the insert for usage of inexpensive materials and disposal or reuse of the invention as desired. The vent tube of the reservoir has a contoured shape generally and preferably attains a conical shape with the diameter of the cone larger superiorly and smaller inferiorly away from the reservoir portion. The conical shape admits air distally into a bottle while emptying liquid into the reservoir while in the feeding position. The conical shape prevents the possibility of propulsion of liquid into the insert portion thus venting the bottle immediately and preventing leakage of liquid from the bottle.

Additionally, the present invention provides an improved emptying of the reservoir. Further, the larger diameter of the conical shaped tube increases the capacity of the reservoir. As the infant empties the bottle and the liquid level drops below the maximum, the liquid occupying the reservoir now, more rapidly and effectively exits the reservoir in the rest position. When a caregiver or infant holds the bottle upright in the rest position, liquid promptly exits the reservoir into the larger diameter of the conical shaped tube and returns the remaining liquid to the bottle.

When the infant chews on the wide neck, large volume nipple and the cylindrical vent tube of the prior art is replaced with a conical vent tube, the possibility of the liquid being propelled up the vent tube can no longer occur. The liquid flows quickly and gently into the reservoir. The present invention allows for instant, complete, and unimpeded movement of any air bubble, present in the venting tube, to immediately exit from the distal end of the vent tube into the distal end of the bottle when the bottle is placed in the feeding position. The vent tube hereby functions in an automatic and continuous fashion as intended by the inventors, and can be held by a caregiver or infant in any position without leakage occurring.

This invention establishes a structured relationship between the container or vessel and the formula within a nursing bottle. The nursing bottle has sufficient size so that as the formula is prepared and deposited within the container, the formula's surface will be at a level below the reservoir for venting purposes. In addition, even when the vessel is inverted, by the infant or caregiver, during feeding, the liquid formula still will not approach the distal insert vent in any position. Thus, this invention provides a container with sufficient bulk and volume, so that the formula or milk as supplied therein will always leave the identified vent port exposed to attain the attributes of venting, for the nursing bottle, at all times.

Thus, no appreciably positive pressure can occur when the bottle is being properly warmed for feeding and no negative pressure can build up in the container at any time, since the vent port is always open, so as to allow for the venting of any negative pressure, internally generated within the container, that may occur as a result of the sucking action of the infant.

Some attributes of the embodiments of this invention employ features of providing sufficient internal volumetric size to the container achieved through usage of containers that are of excessive dimensions, such as being large and spherical in shape, or cylindrical in shape and flattened upon each surface, or which has a size equivalent to that of a Mason jar. In a further embodiment, the container may be of the jar shape, or even contain some concavity upon its sides, to facilitate its lifting. In addition, where the spherical or cylindrical type of container is used, it may have a flattened bottom, to add stability to the nursing bottle, when rested upon a surface.

In the preferred embodiment, the venting port within the insert portion cooperates with a vent tube, and at least one lateral vent aperture, that are built into the insert portion that secures to the top of the container by means of its associated threaded collar that holds the combined insert and vent tube within the vessel, or container, and the conventional nipple, in place. The vertical vent port of the insert opens directly and downwardly into the volumetric center of the reservoir. The insert has at least one lateral port to either side to allow venting as the container is being inverted during usage.

In a further embodiment, the container, collar, and nipple may be of the conventional type, but having the volumetric sizes from the shaped containers as previously explained, but the vent tube and port within the insert may extend to the exterior surface of the container, rather than cooperate with the collar, in the manner as previously described in the '796 patent.

Nevertheless, the orientation of the vent port, regardless what shape or structures the containers may possess, allows the liquid to be below the vent port aperture as the nursing bottle is either at rest, or being inverted as during usage.

Therefore, it is an object of the invention to provide a new and improved venting tube for nursing bottles of infants.

It is a further object of the present invention to dissipate the pressure upon liquid within the nursing bottle, preventing introduction of liquid into the insert portion and thus preventing leaks.

It is a still further object of the present invention to provide immediate exit of air in the venting structure to the bottom of an inverted bottle.

It is a still further object of the present invention to provide an increase in the volume of the reservoir as a result of the larger diameter of the conical shape of its vent and enabling immediate emptying of liquid into the reservoir when the bottle is placed in the feeding position.

It is a still further object of this invention to provide a volumetric sized container for use as a nursing bottle, and which incorporates a vent tube with a reservoir combined with an insert portion that is arranged superiorly, so that the vent port of the insert avoids coverage from any of the formula or milk contained therein, during any usage.

It is an even still further object of this invention is to provide for structured means within a nursing bottle that provides for full and continuous venting of any pressure or vacuum generated within its container, regardless of usage.

Lastly, it is another object of this invention is to provide for the structure of a wide rimmed, or other size, collar for use with a wide mouth, or other sized, container as structured into a nursing bottle, and useful for feeding formula to an infant.

These and other objects may become more apparent to those skilled in the art upon review of the invention as described herein, and upon undertaking a study of the description of its preferred embodiment, when viewed in conjunction with the drawings.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
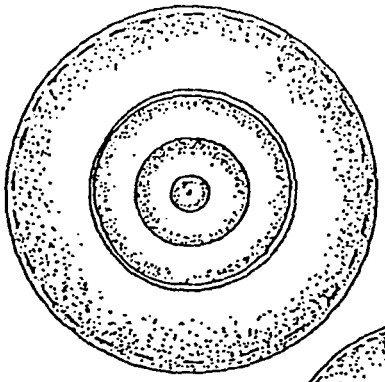
FIG. 1 is a top view of a spherical shaped nursing bottle.

The present art overcomes the prior art limitations by providing a fully vented wide rim, or other size, nursing bottle that provides a conical vent tube to eliminate vacuum within the container and prevent leakage from the container. In referring to the drawings, and in particular FIGS. 1 and 2, the fully vented, wide rim, nursing bottles preceding this invention are disclosed. They include a spherical shaped container 1 that has ample volumetric capacity. When a formula, such as at 2, is applied into the container, at an amount that normally furnishes a feeding for the infant, it will only fill the container to a level below the bottom of the vent tube 3, and distally to the insert and its vent port 4.

Thus, any vacuum built up within its container will be immediately vented, externally of the shown nursing bottle, because of the openness of the vent port 4 of the distal insert, to eliminate any generated vacuum. The nipple 5, the threaded collar 6, and the vent insert 7, are all fabricated as previously described in the '071 patent with the exception that these components may also be fabricated of a wider dimension, so as to fit upon a wide rim style of opening for the shown container 1. In addition, when the nursing bottle of this invention is inverted for feeding an infant, the formula may flow to the opposite side of the inverted container 1, but yet will have a surface level that will still be below the distal insert and its vent port 4, so that any sucking by the infant, during feeding, prevents the formation of any vacuum, within the container, during feeding, by continuous venting through its vent port 4, on through the vent tube 3, and out of the vent insert 7. The container 1 of this invention may include a minor flattened surface, as at 8, at its bottom, to allow the free standing of this nursing bottle.

Figure 2A:
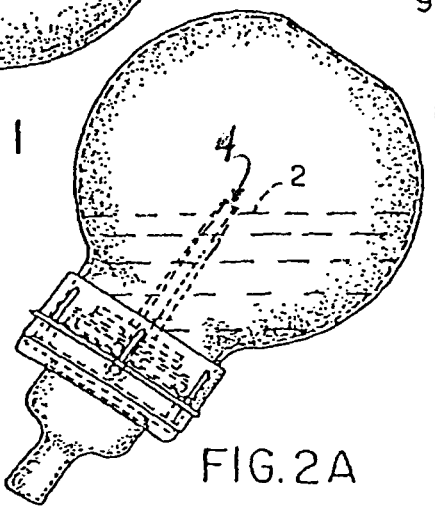
FIG. 2A is a side view of the bottle during usage.
Figure 2:
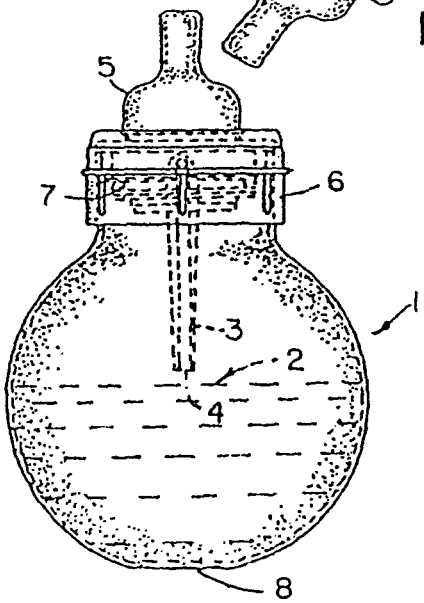
FIG. 2 is a side view thereof.

FIG. 2A shows the container 1 and its nursing bottle when inverted, as during a feeding, to disclose how the fluid level 2 will yet remain below the opened vent port 4, so as to not obstruct the venting of any vacuum generated therein.

Figure 3:
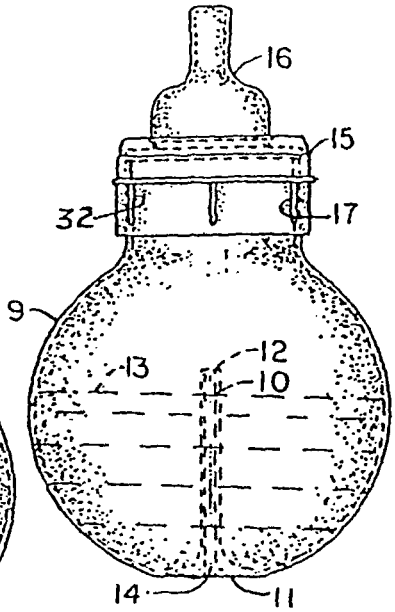
FIG. 3 shows a modification to a spherical shaped nursing bottle wherein the vent tube extends structurally upwardly from its bottom.
Figure 4:
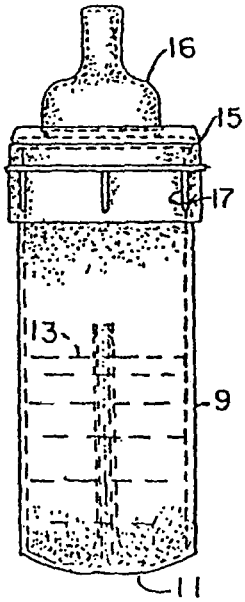
FIG. 4 is a side view of the nursing bottle of FIG. 3.

FIGS. 3 and 4 disclose a modification to the shape of the container 9, with the further modification that the vent tube 10 will be integrally structured with the bottom 11 of the shown container, disposing its vent port generally centrally of the container, as can be noted at 12. Thus, regardless of the position of the container 9, the surface level 13 of the formula will not obstruct the entrance of any air flow into the vent port 12, for venting purposes, into the bottom opening 14 of the shown bottle. This is so regardless whether the container 9 may be positioned vertically, as shown in FIG. 3, or inverted, as can be understood. In this particular instance, the threaded collar 15 and nipple 16 threadily engage to the wide rim 17 of the container 9, which enhances the volumetric capacity of the nursing bottle, and to attain the results required for this particular development. In addition, the structure of a wide rim container 9 is generally spherical, as can be noted in FIG. 3, but flattened on its front and back surfaces, as disclosed in FIG. 4, and yet attains the volumetric capacity for the formula, as desired and required for this development.

Figure 5:
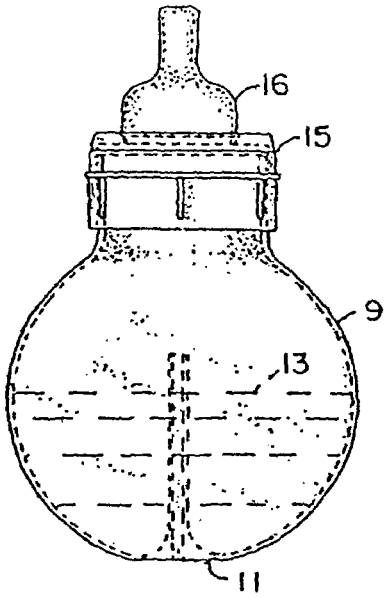
FIG. 5 is a back view of the nursing bottle of FIG. 3.
Figure 6:
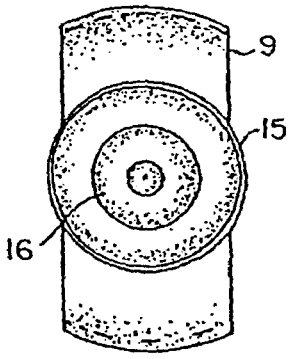
FIG. 6 is a top view thereof.
Figure 11:
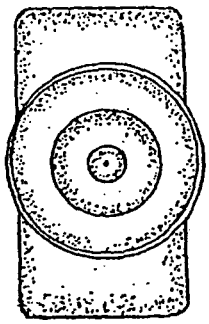
FIG. 11 is a top view thereof.
Figure 12:
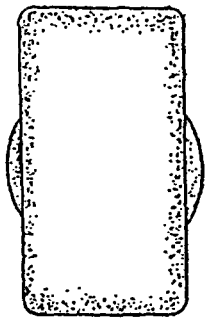
FIG. 12 is a bottom view thereof.
Figure 10:
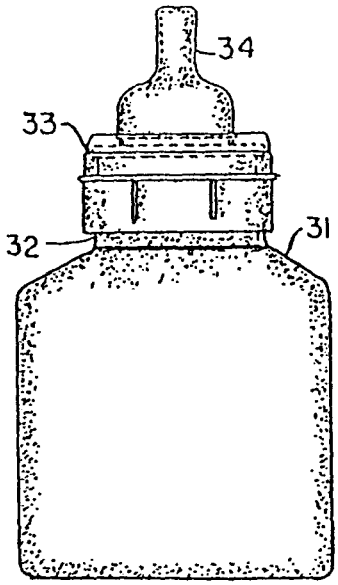
FIG. 10 is a front view of a wide structured nursing bottle of a rectangular configuration having its collar and nipple applied to a wide rim at its upper end.

FIGS. 5 and 6 provide both a back view, and top view, of the modified nursing bottle as previously described in FIGS. 3 and 4.

Figure 7:
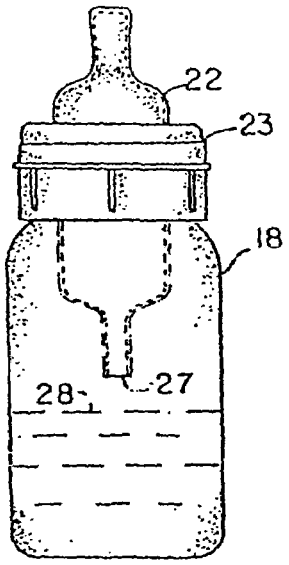
FIG. 7 is a side view of a modified form of nursing bottle having a wide rim configuration for mounting of its collar and nipple, and supporting the vent structure therein.
Figure 9:
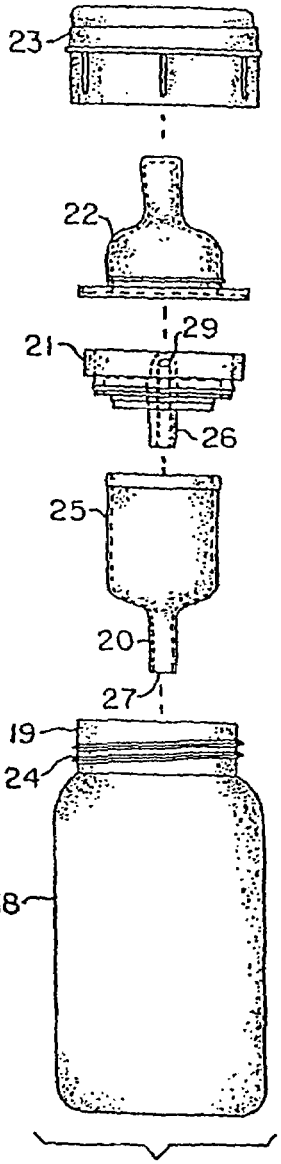
FIG. 9 is an exploded view of the operative components of the structured nursing bottle as shown in FIG. 7.
Figure 8:
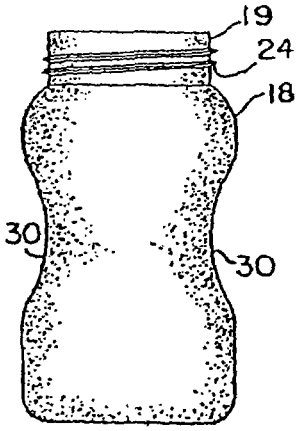
FIG. 8 is a side view of the nursing bottle as shown in FIG. 7.

FIGS. 7 through 9 show a modified nursing bottle of this invention, wherein its container 18 has a Mason jar style of configuration with the wide rimmed 19 opening, at its upper end, for accommodating the vent tube 20, reservoir or receptacle portion 25, the vent insert 21, the nipple 22, and the threaded collar 23, that all threadedly engage onto the threads 24 of the shown container. These components 20 through 23 and 25 are very similar in structure to that as previously described in the '071 patent with the exception that the components may be fabricated to a wider dimension.

The vent tube communicates with its upper inner receptacle portion 25, forming the reservoir-like configuration as noted, and which positions thereon and locates therein the internal vent port 26 of the vent insert 21. But in this particular instance, the vent tube 27 of the vent structure is disposed approximately at the center of the internal space of the shown container 18, to achieve the benefits and results for this embodiment. Hence, the surface level 28 of the formula applied therein will be below the entrance to the vent tube 27, so as to avoid its blockage, regardless whether the container 18 is maintained in its rest position, as shown in FIG. 7, or when the container is tilted to any angle, or should it be inverted, placed on its side or in any position. This allows the vacuum generated within the container, during feeding with the nursing bottle, to always be vented, to the atmosphere. In addition, wherever these vent tube and vent insert configurations are inserted upon the wide rim and held in position by means of the collar 23, the distal insert and vent port 26 internally communicate with the lateral vent passages 29 and open to the atmosphere internally of the collar 23, to provide venting thereof, to achieve the purposes and advantages of this invention.

It can also be noted in FIG. 8 that the sides of the container 18 may be integrally concaved, as at 30, for the gripping and holding of the larger sized bottle, during its usage.

FIGS. 10 through 13 disclose a larger volumetric sized nursing bottle, having a container 31 that is generally rectangular. It may have a wide rimmed opening, as at 32 for accommodating the shown collar 33, its supported nipple 34, the vent tube 35, and the vent insert 36 when installed. The vent insert is shown more carefully in FIGS. 14 and 15, and it can be seen that the bottom of the vent port 37 is open, and internal venting is achieved through the lateral port 38 that extends to the front and back of the insert. In addition, the lateral port 38 is arranged above the neck of the bottle and permits the entrance of air into the container as when the nursing bottle is inverted during a feeding. Nevertheless, in FIG. 13, the level of the liquid will always be at a location spaced from the bottom of the vent tube 35. Furthermore, as in FIG. 15, and in the '071 and '796 patents, the vent insert 36 has the lateral vents 38 that communicate with the vent 35, for the free flow of air, thus relieving any vacuum, generated within the nursing bottle during usage, externally of the bottle, to achieve the results of this embodiment.

Figure 16:
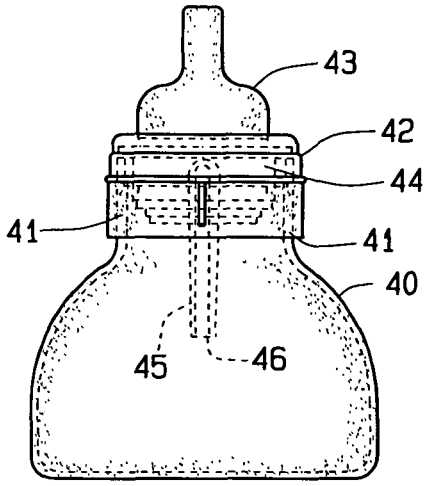
FIG. 16 is a front view of a nursing bottle having a volumetric structured vessel with the collar, vent insert and nipple applied to its wide rim top, for disposing its vent tube, and vent port approximately centrally of its shown container.

FIG. 16 shows a nursing bottle that incorporates a semi-spherical container 40 with an integral wide rim 41, the collar 42, nipple 43, and the vent insert 44. The vent tube 45 extends downwardly into the container 40, with the bottom 46 of the vent tube being arranged at the approximate midpoint of the volumetric capacity of the nursing bottle, to achieve the benefits of this invention.

Figure 17:
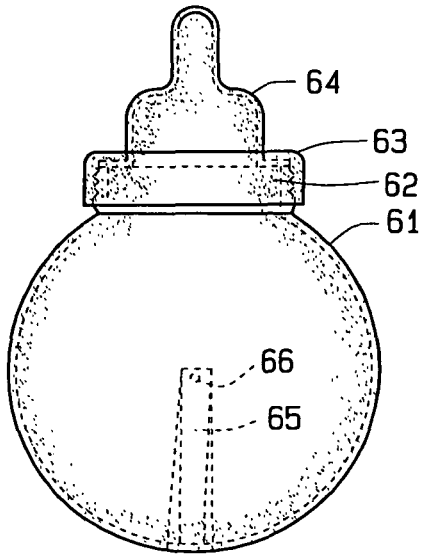
FIG. 17 is a front view of another spherical form of container for a nursing bottle having the vent tube operatively structured and disposed with its bottom segment.

FIG. 17 discloses a spherical nursing bottle wherein its container 61 has mounted to its standard, or wide, rim 62 by threaded engagement the collar 63 and the nipple 64.

The vent tube, in this instance, as at 65, extends integrally upwardly from the bottom of the container 61, and internally vents to the atmosphere, out the bottom of the bottle, and has at its upper end the lateral vent ports 66 as noted. These vent ports are arranged at the approximate midpoint of the volumetric capacity for the container, to achieve the benefits of this invention.

Figure 18:
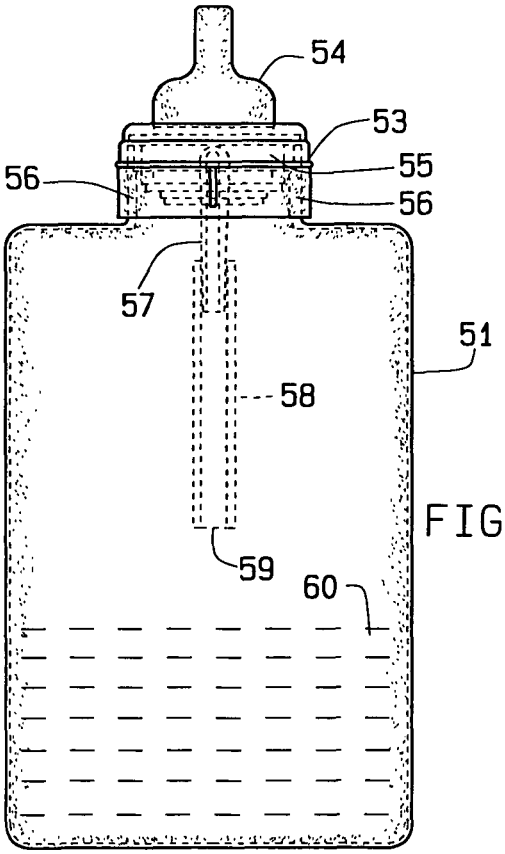
FIG. 18 is a front view of a further rectangular shaped volumetric sized container for a nursing bottle having the collar, vent insert, and vent tube, with or without an extension, all operatively associated therewith.
Figure 19:
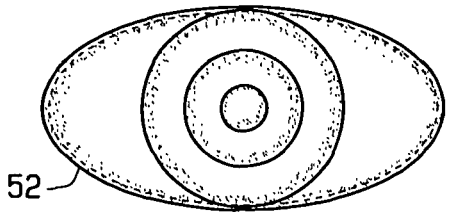
FIG. 19 is a top view of a further modified wide rim nursing bottle of this invention.

FIGS. 18 and 19 disclose a modification to the nursing bottle, wherein its container 51 is generally rectangular of configuration in one dimension, and an oval shape 52 along its vertical disposition. Its collar 53 secures the nipple 54, and the vent insert 55 to the standard rim 56 of the integral container 51, for the nursing bottle. The distal insert and its vent tube 57 extend downwardly, and include an extended vent tube 58, whereby its vent port 59 at its bottom end is disposed approximately, at the volumetric midpoint of the shown container 51 for the nursing bottle. Thus, any formula 60 contained therein for feeding, will always be below the disposition of the vent port 59, regardless whether the nursing bottle is rested upright or inverted.

Figure 20:
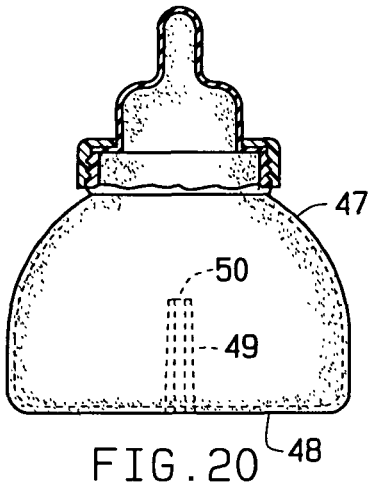
FIG. 20 is a front view thereof.

FIG. 20 shows a similar style of nursing bottle, to that of FIG. 16, but its container 47 has integrally formed of its flattened bottom 48 an upwardly extending vent tube 49, whose upper end 50, forming the vent port, is arranged at the approximate volumetric midpoint of its container.

FIGS. 21 through 25 show variations upon the arrangement of the vent tube of this embodiment. As noted, in FIG. 21 the shown nursing bottle has its container 67 mounting upon its wide rim 68, its threaded collar 69, and the shown nipple 70. For venting purposes, the vent tube 71 is integrally formed of the container 67, and extends radially inwardly, along an oblique angle, into the approximate midpoint of the container, having its vent port 72 disposed approximately at this location. Thus, any formula 73 provided therein, of a typical amount, will always be below the entrance to the vent port 72, and not cause any leakage. Regardless whether the nursing bottle is being stored, or inverted as during usage.

Figure 21:
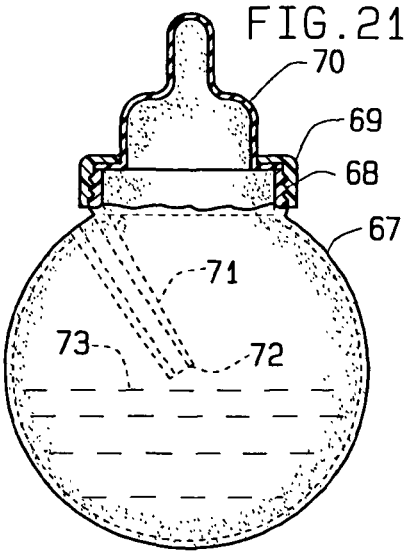
FIG. 21 is a further modified wide rim nursing bottle of this invention having its vent tube extending inwardly towards centrally from the upper container surface.
Figure 22:
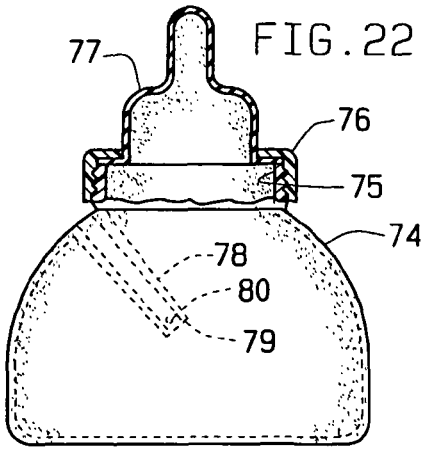
FIG. 22 is a further modified wide rim nursing bottle having its oblique vent tube extending inwardly from the approximate upper surface of its container.

FIG. 22 shows the hemispherical style of container 74 that has a standard rim 75, to which the threaded collar 76 and the nipple 77 are attached. Similar to FIG. 21 (with its vent tube 71), the vent tube 78 is integrally formed of the container, and is arranged obliquely within it, to dispose its vent port 79 and alternatively its lateral vent port 80, internally at the approximate volumetric midpoint of the container.

Figure 23:
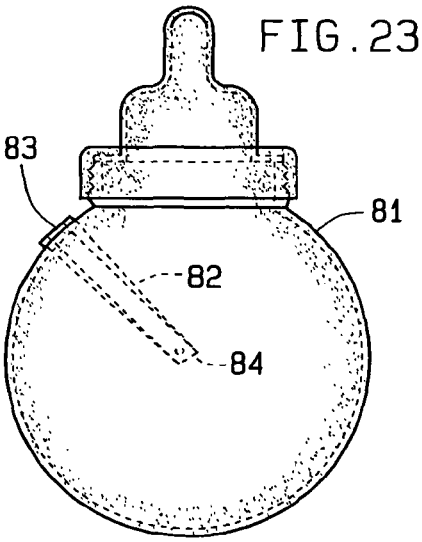
FIG. 23 is a further modified wide rim nursing bottle having the vent tube extending inwardly from the surface of its container.

FIG. 23 is similar to FIG. 21, but in this instance, the container 81 has its vent tube 82 arranged further down the side of the shown container, opening to atmosphere as at 83, and having its vent port 84 provided at the approximate midpoint of the container 81.

Figure 24:
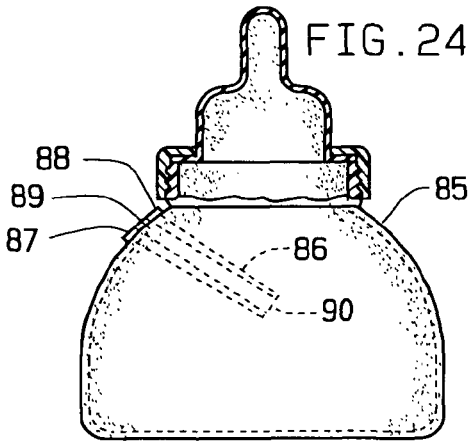
FIG. 24 is similar to the bottle of FIG. 22, with the vent tube structured further downwardly along the side of the shown bottle.

FIG. 24 shows a structure for a nursing bottle similar to FIG. 22, but the container 85 has its vent tube 86 integrally formed further down the side of the container, as at 87. This may be integrally formed, or structurally applied thereto, as by adherence of the flanges 88 to the opening 89 provided through the wall of the container 85. The inner end of the vent tube 86, has its vent port 90, arranged, at the approximate volumetric midpoint of the container, to achieve the results of this embodiment.

Figure 25:
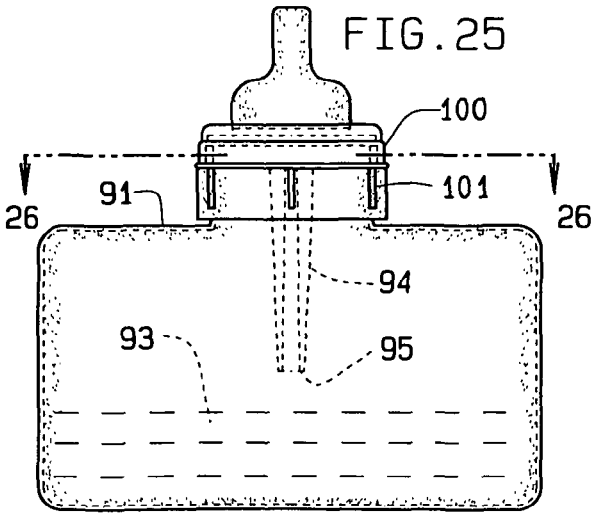
FIG. 25 is a front view of a further shaped vented nursing bottle of this invention.
Figure 26:
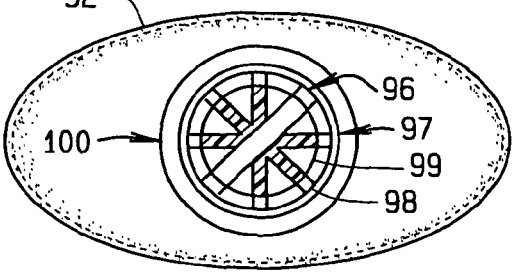
FIG. 26 is a top view of an oval shaped wide rim nursing bottle of this invention.

FIGS. 25 and 26 disclose a further modification to the nursing bottle of this invention, wherein its rectangular configured container 91 has an oval appearance along the vertical disposition in FIG. 26, as at 92. It provides sufficient volumetric capacity so that the surface of the formula added thereto, as at 93, will always be below the vent tube 94, and its vent port 95, regardless of the position undertaken by the nursing bottle. In accordance with the structure of the venting characteristics of this development, and FIGS. 25 and 26, the vent tube 94 has lateral vents 96 that extend laterally to the sides of the vent insert 97, and which vent any pressure or vacuum developed within the container 91 to the atmosphere, by passing through the configured threads 101.

As known from the '071 and '796 patents, the vent insert 97 includes a series of supporting vanes 98 that provide intermediate spacing, as at 99, and through which the formula may flow, when the nursing bottle is inverted, as during a feeding. But, the lateral vents 96 communicate with the vent tube 94, to allow passage of air eliminating any vacuum. The air passes through the imperfect seal formed of the threaded connection between the collar 100, and the threads 101 through the vents of a standard rimmed container 91. The criticality regarding the location of the vent port 95, at the approximate volumetric midpoint of the shown container 91, prevents any leakage from it, when formula is applied therein, so that venting occurs, regardless of the position of the nursing bottle.

Figure 13:
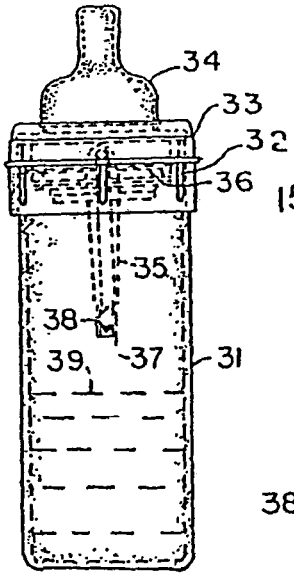
FIG. 13 is a side view thereof, and showing its internal venting structure.
Figure 14:
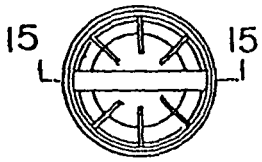
FIG. 14 is a top view of the vent insert applied within the collar when affixed to the wide rim of the container of the nursing bottle as shown in FIG. 13.
Figure 15:
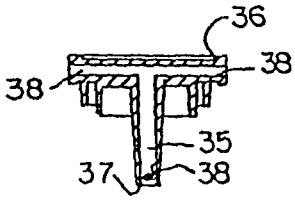
FIG. 15 is a sectional view of the vent insert, taken along the line 15-15 of FIG. 14.
Figure 27:
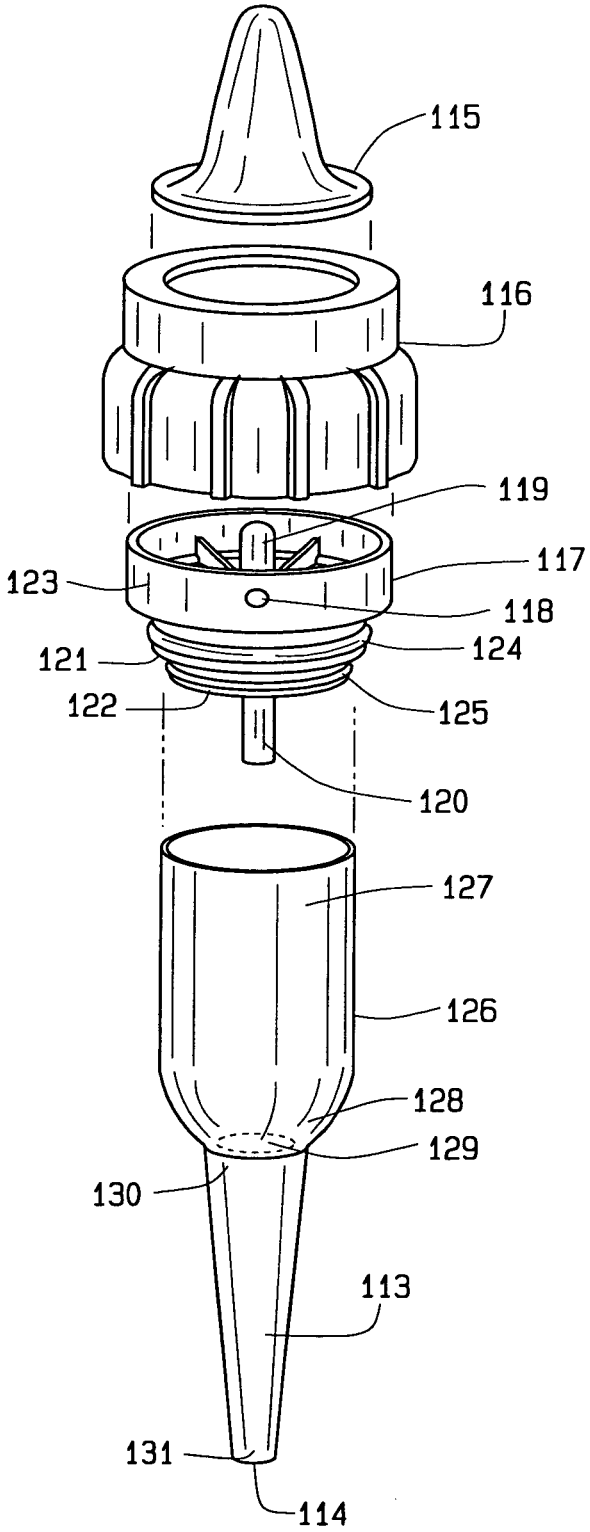
FIG. 27 is an exploded view of the vent tube and appurtenant components.
Figure 27A:
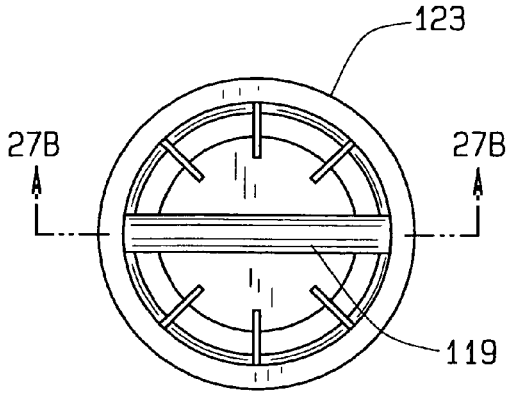
FIG. 27A is a top view of the vent insert.
Figure 27B:
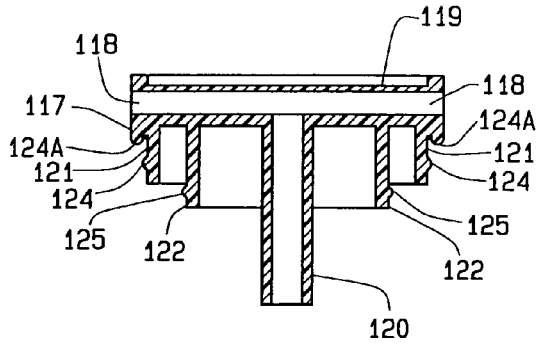
FIG. 27B is a sectional view of the vent insert.

The bottle components shown in FIG. 27 share similarities with those shown assembled previously in FIGS. 13-15. FIG. 27 shows an exploded view of the components less the liquid container or bottle. A nipple 115 extends out from a collar 116 that secures to the bottle 1 as later also shown in FIG. 31. Between the collar and the bottle, a vent insert 117 grasps the rim of the bottle 1. The vent insert has a generally hollow cylindrical shape with a low height perimeter wall 123. Across the diameter, the vent insert 117 has a lateral vent 119, see FIG. 27A, with a centered hole towards the direction of the bottle as shown in FIG. 27B. The lateral vent has two opposed openings 118 that generally communicate air between the bottle 1 and the atmosphere. The insert 117 has a major lip 121 and a minor lip 122 concentric and slightly below the major lip 121 as then shown in FIG. 27B. The major lip is also a hollow cylindrical shape contiguous, but of slightly larger diameter, than the inside diameter of the neck of the bottle. In this manner, the vent insert can be applied in a tight seal within the neck of the bottle, during its installation, forming a second seal, and thereby preventing any leakage from the vent insert and also simultaneously allowing the air venting desired from the structure of the insert and its applicable usage in a nursing bottle. The first seal 124A, being a circumferential bead or bulge on the inferior lateral surface of the insert 117 is compressed onto the superior aspect of the rim of the container as the collar is tightened onto the container. The aperture providing air to the bottom of the bottle, as at 114, for the contoured vent tube 113, shown here in the preferred embodiment as conical though other shapes are possible as later shown in FIG. 28. In addition, the bottom of the vent tube typically ends, in this instance, proximate to the internal bottom of any container upon which the venting structure of this invention applies, regardless of whether it be the standard bottle, a wide rim bottle, or the like. The major lip of insert 117 has a circumferential bead, or bulge, 124 of slightly larger diameter than the major lip. The bulge of the major lip seals the insert to the inner diameter of the bottle. The major lip has a greater outer diameter than that of the inner diameter of the bottle thereby forming a seal as the major lip of the insert is inserted into the neck of the bottle. Depending from the inferior surface of the insert 117, the vent insert 117 has the minor lip 122 as a hollow cylindrical shape of lesser diameter than the major lip. The minor lip 122 has a circumferential bead, or bulge, 125 of slightly larger diameter than the minor lip. The minor lip has an outer diameter greater than that of the inner diameter of the reservoir. The minor lip seals the reservoir 126 of the present invention to the vent insert 117 as in the prior patents of the Applicants.

The vent tube 113 has a reservoir 126 having a generally hollow cylindrical shape with an open top 127 and a partially closed bottom 128. The bottom is smoothed and rounded as it descends distally from the top. At the center of the bottom 128, an aperture 129 provides passage to the vent tube 113 joined to the bottom. The vent tube then attains a hollow truncated conical shape with the larger diameter 130 located towards the reservoir 126 and the narrow diameter 131 located distally.

Coaxial with the vent tube 113, the vent insert 117 has the distal insert or internal vent tube 120 centered upon the hole in the lateral vent 119 and perpendicular to the lateral vent 119 within the insert wall 123. The internal vent tube 120 is a hollow cylinder typically of a length in excess of its diameter. The internal vent tube 120 communicates air, but not feeding liquid in the current invention, from the lateral vent 119 into the reservoir 126 of the vent tube 113.

Figure 28:
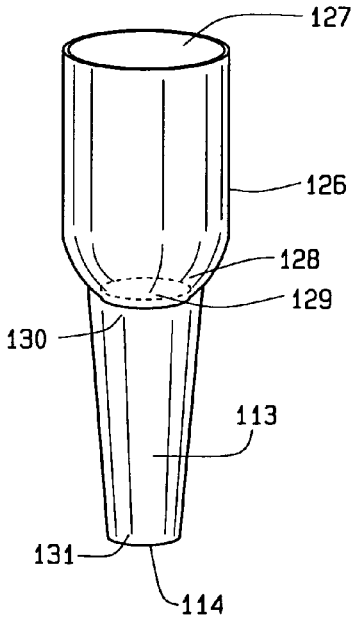
FIG. 28 is an isometric view of the conical vent tube having a large diameter proximally.

FIG. 28 shows the vent tube 113 alone and having a large diameter 130 distal to and similar in diameter to the bottom 128 of the reservoir 126. The vent tube 113 then tapers distally towards the narrow diameter 131. In the preferred embodiment, the larger diameter 130 is approximately three times that of the narrow diameter 131, in a minimum ratio of about 2:1.

Figure 29:
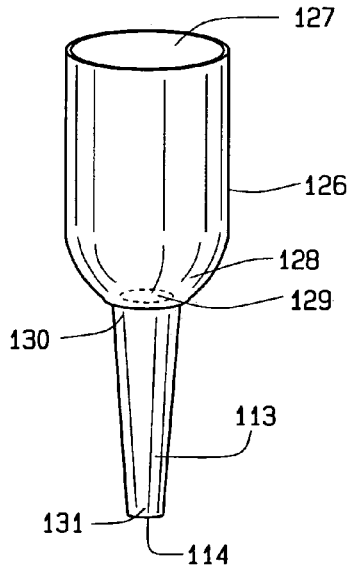
FIG. 29 is an isometric view of the conical vent tube having a narrow diameter distally.

FIG. 29 again shows the vent tube 113 but with the larger diameter 130 substantially less than previous embodiments. In this embodiment, the larger diameter 130 is typically approximately 2-3 times the diameter of the narrow diameter 131. Towards the narrow diameter 131, the vent tube 113 tapers distally as before. In this embodiment, the large diameter 130 is greater than the narrow diameter 131, in the range of approximately 4:1 to approximately 1:1 ratio, with the preferred ratio of approximately 3:1. It is here shown in a ratio of about 2:1.

Figure 30:
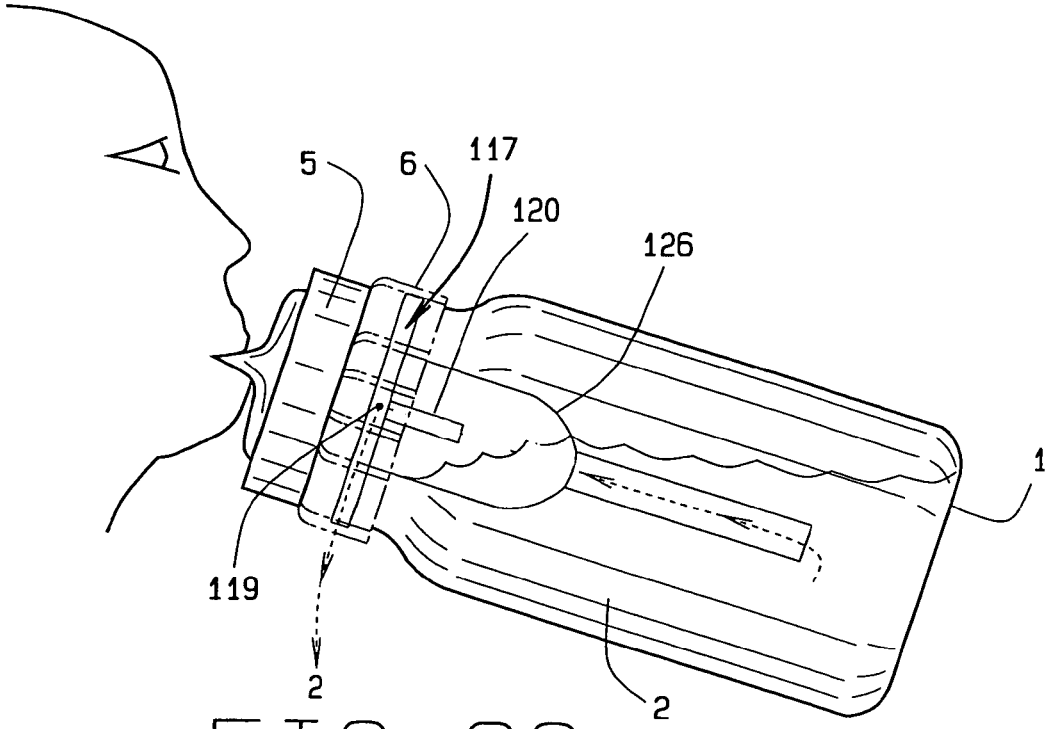
FIG. 30 PRIOR ART
FIG. 30 shows a prior art vented bottle with a cylindrical tube utilizing a wide neck bottle and showing possible leakage during use by an infant from instantaneous, forceful, and rapid compression of the wide neck nipple.

FIG. 30 shows an aberration that only occurs with a large nipple upon a wide neck bottle that has a cylindrical venting tube, generally seen in a prior art bottle in use by a chewing infant with the bottle lowered below a horizontal orientation for ready grasping by the infant. This bottle 1 has a cylindrical tube of constant diameter and large volume nipple. With a down inclined bottle, the tube contacts the feeding liquid 2. When the nipple is quickly, or instantaneously, compressed, as during chewing, the compressed air above the liquid pressurizes the liquid briefly within the container. The compressed air advances from the nipple through the vanes of the insert and into the container, pressurizing it. The pressurized air can possibly force the liquid up into the prior art cylindrical vent tube having straight and constant diameter walls, but only when the inferior end of the venting tube is submerged in the liquid and a large volume nipple is used, where inferior designates the position, location, or direction, opposite the nipple. The volume of the large nipple exceeds the volume of the vent tube thus upon abnormally compressing the large nipple, the feeding liquid within the vent tube abruptly may abruptly rise towards the nipple, somewhat as a spurt, and then may leak through the insert and out of the collar.

Figure 30A:
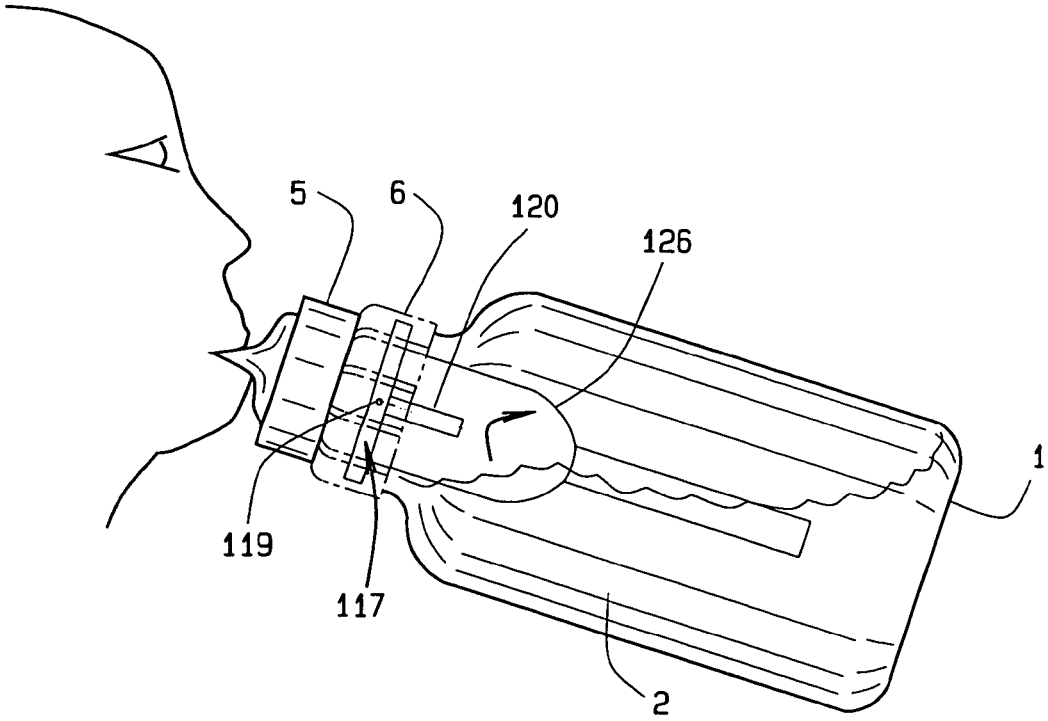
FIG. 30A PRIOR ART
FIG. 30A shows a prior art vented bottle with a cylindrical tube utilizing a narrow neck bottle with a small volume nipple and showing no leakage during use by an infant.

FIG. 30A then shows a small nipple upon a narrow neck bottle, demonstrating that no leakage will occur in the conditions of a narrow neck container, small volume of compressible air in the nipple, cylindrical vent tube terminating below the surface of the liquid, and the rapid compression of the small volume nipple. The volume of the small nipple is less than the volume of the vent tube and thus upon chewing the small nipple, the feeding liquid within the vent tube remains therein and avoids an abrupt rise or spurt towards the nipple, and no leak takes place out of the collar.

Figure 31:
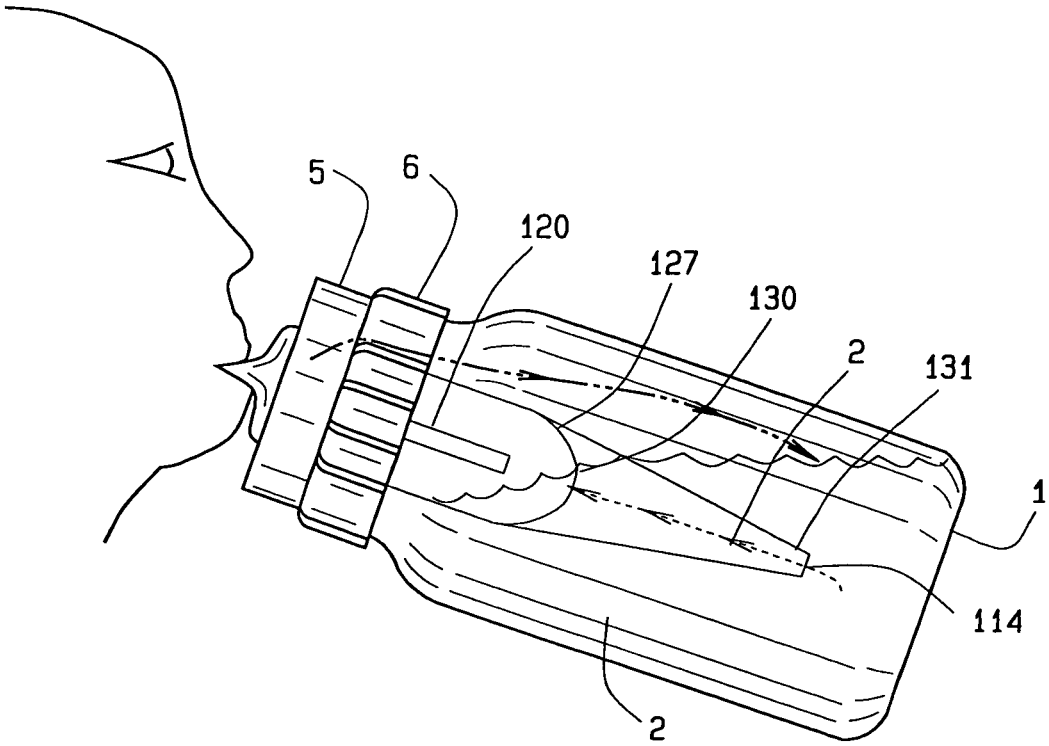
FIG. 31 shows a vented bottle with a conical venting tube upon a wide neck bottle with a large volume nipple without any leakage during use by an infant.
Figure 31A:
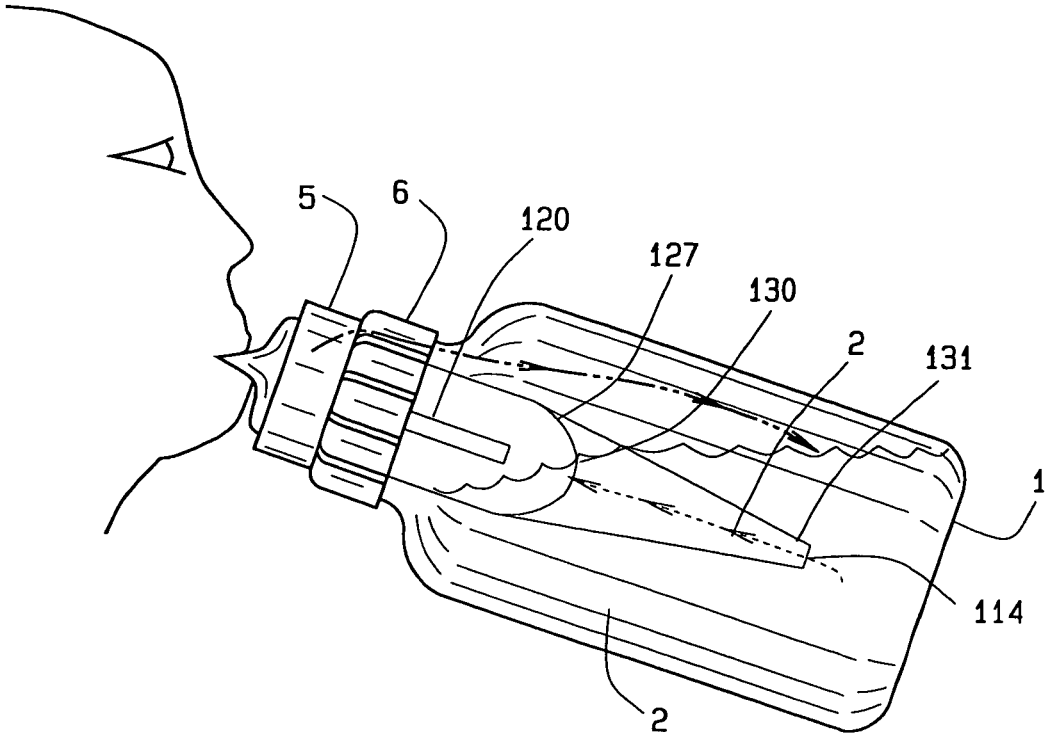
FIG. 31A shows a vented bottle with a conical venting tube upon a narrow neck bottle with a small volume nipple without any leakage during use by an infant.

The conical vent tube of this embodiment, shown in FIG. 31, dissipates the feeding liquid induced into the vent tube. A conical shaped tube dissipates the pressure upon the liquid within the tube as the tube diameter expands and the feeding liquid gently flows into the reservoir instead of the lateral tube of the insert which only rarely occurs in the prior art. Again, this aberration in the prior art, can only occur with a combination of a cylindrical vent tube being submerged in the feeding liquid, a wide necked bottle combined with a wide neck nipple having a large volume of compressible air, and the infant quickly compressing the air in the large volume nipple. Then as later shown in FIG. 31A, no leaks occur with a feeding container with a narrow or standard neck bottle, small volume nipple, conical vent tube terminating below the surface of the liquid, rapid compression of a small volume nipple.

Where a bottle 1 in FIG. 31 has a vent tube of a conical shape and increasing diameter from the narrow distal end 131 to the wider proximal end 130, an infant chewing on the nipple 5 could pressurize the liquid 2 but the increasing diameter of the conical vent tube increases the incremental volume inside the tube and deters feeding liquid 2 from reaching the insert 117, as shown in FIGS. 27-30, and possibly leaking out of the collar 6. The increasing conical vent tube diameter limits any pressure increases within the bottle 1 and thus the possibility of leaks from the bottle are prevented by the present invention. Thus, the propulsion of liquid to the insert cannot occur in a narrow neck bottle, see FIGS. 30A, 31A, with either a cylindrical or conical venting tube due to the smaller amount of compressible air in the smaller nipple. The movement of liquid toward the insert in the wide neck bottle with the larger diameter nipple, that has a greater volume of compressible air, can only occur, rarely, when a cylindrical venting tube is used and is submerged in the liquid while in the resting position and only with rapid compression of the wide necked nipple as in FIG. 30. When a conical shaped venting tube is used at any time, as in FIGS. 31, 31A, or when a narrow, or standard, bottle diameter is used, as in FIGS. 30A, 31A, this phenomenon can never occur.

Figure 32:
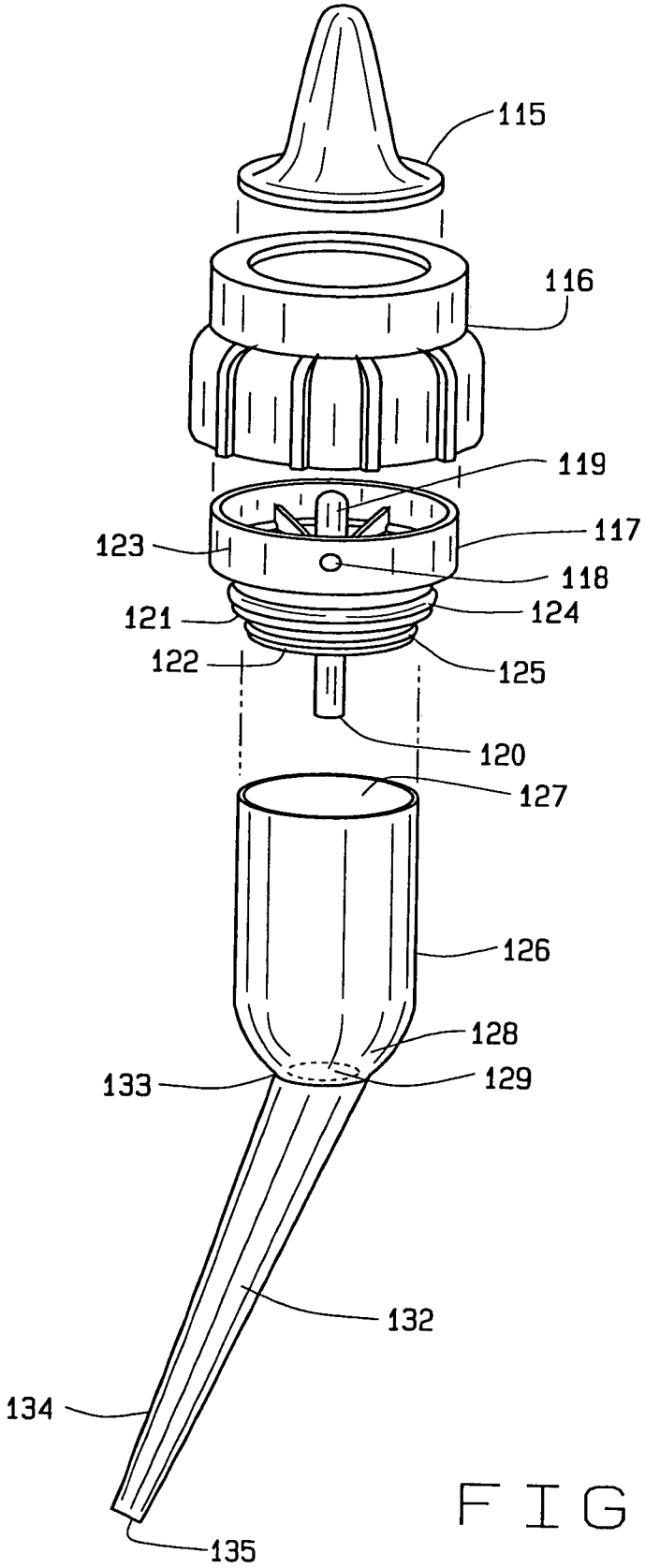
FIG. 32 is an exploded view of the canted conical vent tube and appurtenant components.

The bottle components shown in FIG. 32 share similarities with those shown previously in FIG. 27. This embodiment of the invention appears as an exploded view of the components less the liquid container or bottle. A nipple 115 extends out from a collar 116 that secures to the bottle 1, as shown earlier in FIG. 31. Between the collar and the bottle, a vent insert 117 grasps the rim of the bottle 1. The vent insert has a generally hollow cylindrical shape with a low height perimeter wall. Across the diameter, the vent insert 117 has a lateral vent 119 with a centered hole towards the bottle. The lateral vent has two opposed openings that generally communicate air between the bottle 1 and the atmosphere. The insert 117 has the lips and other features thereof as previously described. In this manner, the vent insert can be applied in a tight seal within the rim of the bottle as its first seal, with the second seal achieved by mating on the top edge of the feeding container, during its installation, and thereby preventing any leakage of liquid from the vent insert, however, the desirable air venting from the structure of the insert and its applicability and usage in a nursing container is preserved. The internal vent tube 120 descends from the vent insert 117 into the reservoir 126 when the present invention is assembled. The internal vent tube 120 is a hollow cylinder of a length in excess of its diameter. The internal vent tube 120 communicates air, but not feeding liquid in the current invention, from the lateral vent 119 into the reservoir 126 of the reservoir vent tube 132. The internal vent tube 120 is generally parallel to the longitudinal axis of the reservoir.

The vent tube 132 has a reservoir 126 with a generally hollow cylindrical shape with an open top 127 and a partially closed bottom 128 as before. The bottom is smoothed and rounded as it descends distally from the top. At the center of the bottom 128, an aperture 129 provides passage to the vent tube 132 joined to the bottom. The vent tube then attains a hollow truncated conical shape at an angle to the plane of the aperture. Generally the vent tube in this embodiment is bent or canted unlike the previous embodiments. The cant of the vent tube matches the angle of the nursing bottle later shown in FIG. 35. The vent tube 132 is also at an angle to the internal vent tube 120. The larger diameter 133 of the vent tube is located towards the reservoir 126 and the narrow diameter 134 located distal from the reservoir. The vent tube 132 has an aperture 135 at the narrower diameter through which air vents to the bottom of the bottle when the bottle is positioned with the bottom tilted upwardly as during feeding of an infant.

Figure 33:
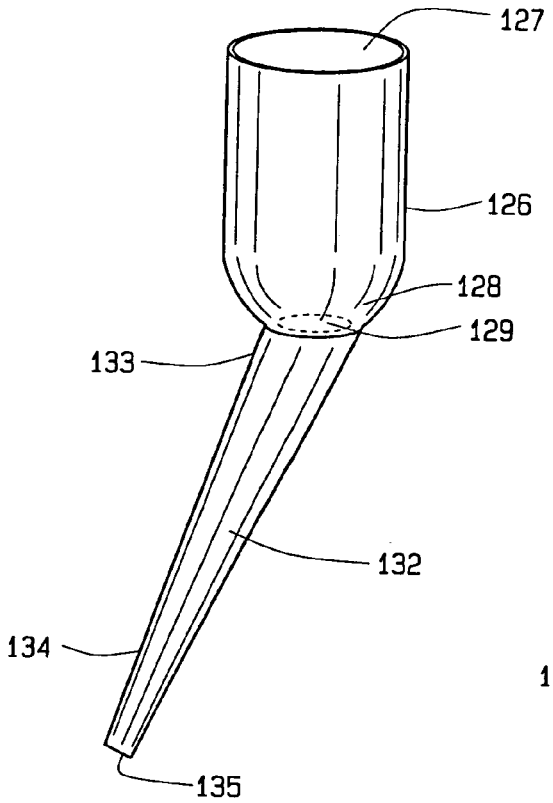
FIG. 33 is an isometric view of the canted conical vent tube having a wide diameter proximally.

FIG. 33 shows the vent tube 132 separated from the other components of the nursing bottle. The vent tube 132 has a large diameter 133 proximate to and similar in diameter to the bottom 128 of the reservoir 126. The vent tube 132 then tapers distally towards the narrow diameter 134 and outwards and away from the centerline or longitudinal axis of the reservoir. In this embodiment, the vent tube has an angle of about approximately 15 to about approximately 25 degrees.

Figure 34:
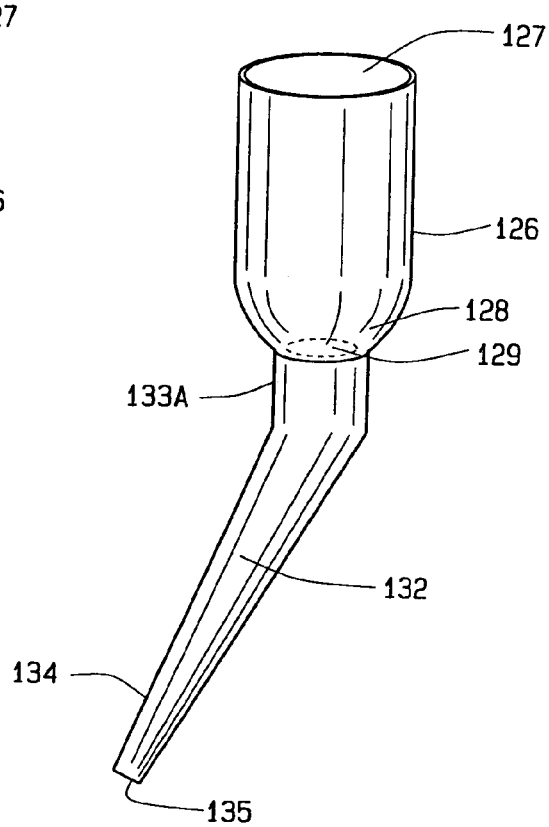
FIG. 34 is an isometric view of the canted conical vent tube having a spout proximally and the narrow diameter distally.

FIG. 34 shows the vent tube 132 again without the vent insert and other components of the nursing bottle. In this embodiment, the vent tube has a cant as before but has a spout 133A that connects to the reservoir. The spout is generally a hollow cylinder and of similar diameter to the aperture 129 of the reservoir. The spout is also coaxial with the reservoir and spaces apart the larger diameter 133 of the vent tube from the reservoir. The spacing apart aids in fitting the canted vent tube within an angled nursing bottle. As before, towards the narrow diameter 134, the vent tube 132 tapers distally and angles outward from the centerline. In this embodiment, the large diameter 133 is greater than the narrow diameter 134, generally in the range of 2:1 to 3:1.

Figure 35:
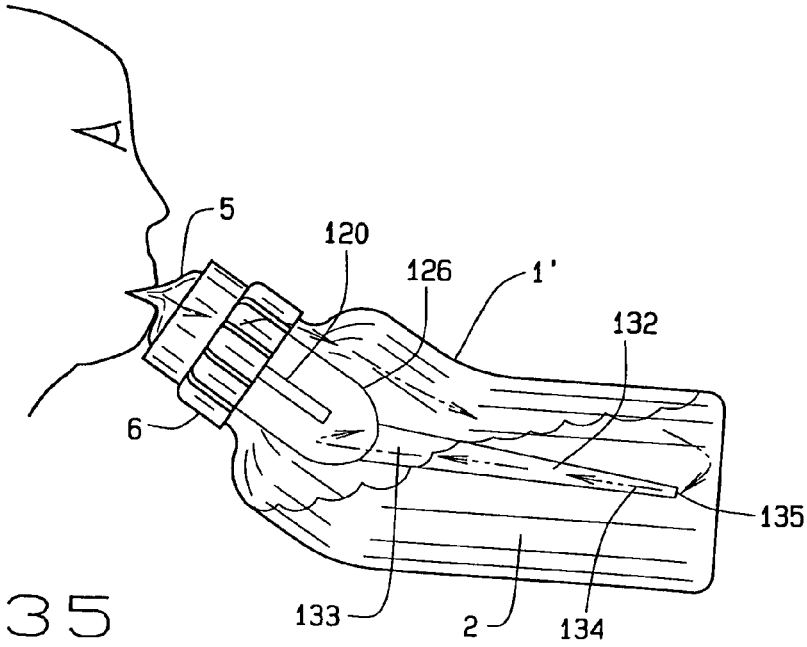
FIG. 35 shows a vented bottle with a canted tube without a leak, even when held with the vent tube submerged in liquid.

The tapered vent tube of an embodiment, shown in FIG. 35, dissipates the pressure of the feeding liquid induced into the vent tube of an angled bottle. A conical shaped tube at an angle to the centerline of the bottle dissipates the pressure upon the liquid within the tube as the tube diameter expands and the feeding liquid gently flows into the reservoir instead of possibly flowing into the venting tube of the insert. The cant of the vent tube also keeps it spaced apart from the wall of the bottle. The angle of the container or bottle eases grasping of the bottle by an infant with developing motor skills and reminds the caregiver to keep the head of the infant in a more raised position. Where an angled bottle 1' in FIG. 35 has a vent tube 132 including a conical shape and increasing diameter from the narrow distal end 134 to the wider proximal end 133, an infant chewing on the nipple 5 may cause pressure to be applied to the liquid 2 but the increasing diameter of the vent tube increases the incremental volume inside the tube and deters feeding liquid 2 from possibly approaching the insert 117, as shown in FIG. 30, and leaking out of the collar 6. The increasing vent tube diameter dissipates any pressure increases occurring within bottle 1' when it is a wide neck bottle, or any other bottle, utilizing larger nipples that have a greater volume of compressible air, and thus the possibilities of leaks are prevented by the present invention.

Figure 36:
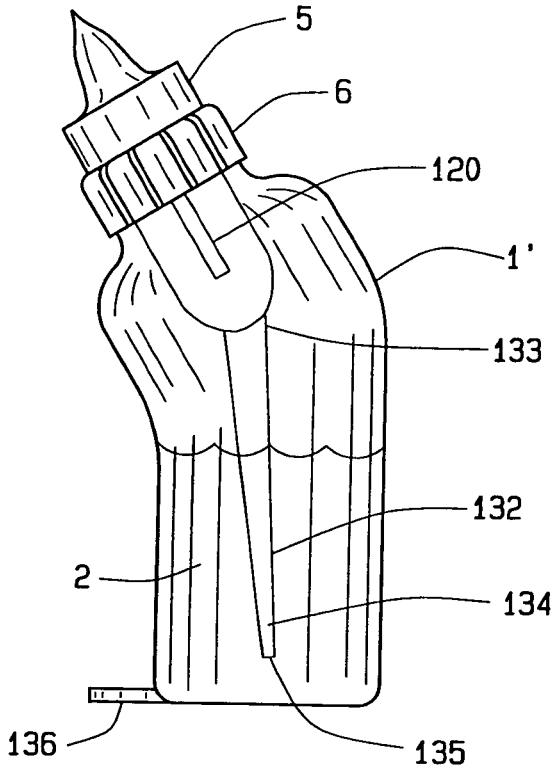
FIG. 36 describes a side view of the vented bottle with a canted tube when the vented bottle is positioned upright.

Another embodiment appears upright in FIG. 36. The angled bottle 1' has a nipple 5 secured upon the bottle with a collar 6. The reservoir 126, as seen in FIG. 32, connects to the vent insert 117 opposite from the nipple. The canted venting tube 132 used in this embodiment descends from the upper portion of the bottle 1' into the feeding liquid 2 here shown in the lower portion of the bottle. This bottle has an angle that extends the nipple away from the centerline of the bottle. The extended nipple and connecting parts move the center of gravity of the bottle away from the center of the bottle. If feeding liquid rises to the upper portion of the bottle, the center of gravity of the bottle moves in the horizontal direction of the nipple. With the center of gravity moved far enough outwards, the bottle 1' has a risk of tipping. The present invention has a foot like stabilizing base 136 joined to the bottom of the bottle that extends also in the horizontal direction of the nipple. The stabilizing base extends the tipping point from the edge of the bottle to the edge of the stabilizing base. An extended tipping point reduces the risk of a full or nearly full angled bottle 1' tipping over when placed in an upright position.

Figure 37:
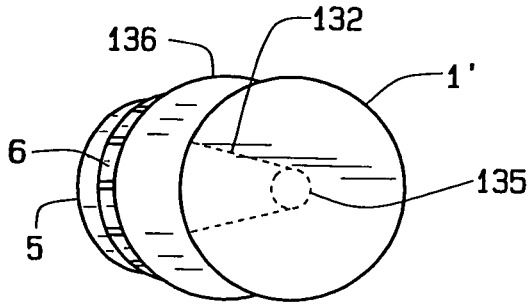
FIG. 37 shows a bottom view of the vented bottle having a stabilizing base or foot.

FIG. 37 shows the angled bottle 1' from the bottom with the stabilizing base 136 installed. The stabilizing base 136 joins to the bottom of the bottle 1' and provides a flat and continuous surface upon which the bottle 1' stands. In this embodiment, the stabilizing base is crescent shaped with the widest part of the crescent located upon a line between the center of the bottle, shown by the narrow diameter 135 of the vent tube, and the nipple shown obscured by the collar 6. The stabilizing base tapers in width until the stabilizing base approaches the bottle tangentially at two opposed points. The stabilizing base 136 itself has a generally flat planar shape with two curved, crescent shaped edges, an outer convex edge and an inner concave edge. The concave edge of the stabilizing base joins to the bottom of the bottle 1' as previously described.

Figure 38:
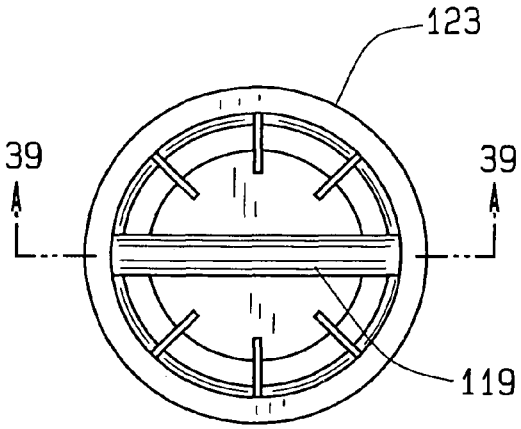
FIG. 38 shows a top view of the insert of this invention with an extended perimeter flange.

FIG. 38 shows a top view of the insert of the present invention for installation upon a bottle or other nursing container. Between the collar and the bottle, a vent insert 117 grasps the lateral rim of the neck of a bottle 1. The vent insert has a generally hollow cylindrical shape with a low height perimeter wall 123. Across the diameter, the vent insert has a lateral vent 119 with a centered hole towards the direction of the bottle as shown in FIGS. 39A, B, C.

Figure 39A:
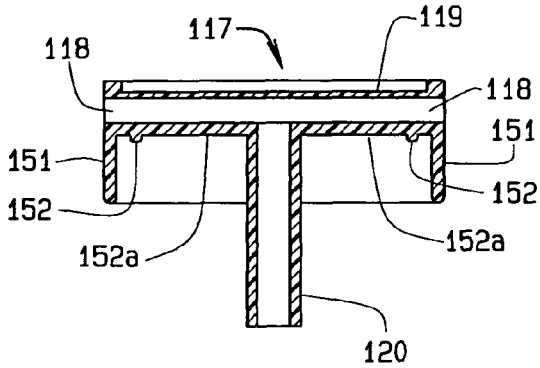
FIG. 39A shows a sectional view of an alternate embodiment of the insert of this invention with an extended perimeter flange.

The lateral vent, of FIG. 39A, typically has two opposed openings 118 that generally communicate air between the bottle and the atmosphere. The insert 117 has a perimeter flange 151 here shown in two spaced apart sections. The vent insert 117 has the perimeter flange at its lateral surface upon the perimeter of the insert. The perimeter flange is also a hollow cylindrical shape, generally perpendicular to the diameter of the insert and has an outer diameter that of the diameter of the vent insert. In this manner, the vent insert can be applied in a tight seal upon the exterior of the rim of the neck of the bottle as well as the seal formed between the inferior bulge 152, or bead, of the insert and the top of the rim of the bottle, thus further minimizing any leakage from the vent insert. Here, the inferior bulge or bead is located upon the surface 152*a* of the insert opposite where the flange of the nipple abuts the insert. This arrangement allows the desired air venting from the structure of the insert and its applicable usage in a nursing bottle. Inwardly of the perimeter flange, the insert has a circular bulge, or bead, 152 of lesser diameter than the perimeter flange and greater diameter than the preferred minor lip. The circular bulge 152 generally has the diameter of the neck of the bottle so that the circular bulge forms a second seal between the insert and the top edge of the neck to prevent leakage from within the bottle.

Generally installed coaxial with the vent tube of the reservoir, the vent insert 117 has the distal insert or internal vent tube 120 centered upon the hole in the lateral vent 119 and perpendicular to the lateral vent 119 within the insert wall 123. The internal vent tube 120 is a hollow cylinder of a length typically in excess of its diameter. The internal vent tube 120 communicates air, but not feeding liquid in the current invention, from the lateral vent 119 into the reservoir 126 of the vent tube 113 (see FIG. 43). In this embodiment, the reservoir connects proximally to the inferior surface, as at 152*a*, of the insert generally by chemical welding, sonic welding, spin welding, an adhesive, a pressed fit, or other means.

Figure 39B:
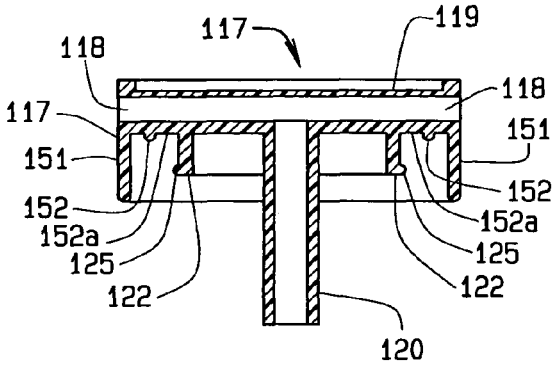
FIG. 39B shows further sectional views of the current invention with a concentric flange.

The preferred embodiment, of the vent insert and the connection of the reservoir, is shown in FIG. 39B. As before, the lateral vent typically has two opposed openings 118 that generally communicate air between the bottle and the atmosphere. The insert 117 has a perimeter flange 151 here shown in two spaced apart sections, and at least one concentric minor lip 122 that can be press fitted onto the reservoir. The vent insert 117 has the perimeter flange at its lateral surface upon the perimeter of the insert. The perimeter flange is also a hollow cylindrical shape, generally perpendicular to the diameter of the insert and has an outer diameter that of the diameter of the vent insert. In this manner, the vent insert can be applied in a tight seal upon the exterior of the rim of the neck of the bottle as well as the seal formed between the inferior bulge 152 of the insert and the top of the rim of the bottle, thus reducing leakage from the vent insert. This arrangement allows the desired air venting from the structure of the insert and its applicable usage in a nursing bottle. Inwardly of the perimeter flange, the insert has a circular bulge 152 of lesser diameter than the perimeter flange and greater diameter than the minor lip 122. The circular bulge 152 generally has the diameter of the neck of the bottle to form a second seal between the insert and the top edge of the neck.

Depending from the inferior surface, as at 152*a*, of the vent insert 117, the vent insert has one minor lip 122 with a hollow cylindrical shape of lesser diameter than the perimeter flange for securing the insert to the reservoir. The minor lip has lesser height than the perimeter flange 151 but sufficient height for a secure press fit within the proximal end of the reservoir. The reservoir secures to the inferior surface, 152*a*, of the insert by approximating the medial or lateral surface of a single inferiorly directed lip. The minor lip seals the reservoir to the vent insert 117 outwardly of the internal vent tube 120.

Coaxial with the vent tube 113 of the reservoir, the vent insert 117 has the internal vent tube 120 centered upon and perpendicular to the lateral vent 119 within the insert wall 123. The internal vent tube 120, a hollow cylinder with a length typically greater than its diameter, communicates air, but not feeding liquid from the lateral vent 119 into the reservoir 126 (see FIGS. 28, 29) of the vent tube 113.

Figure 39C:
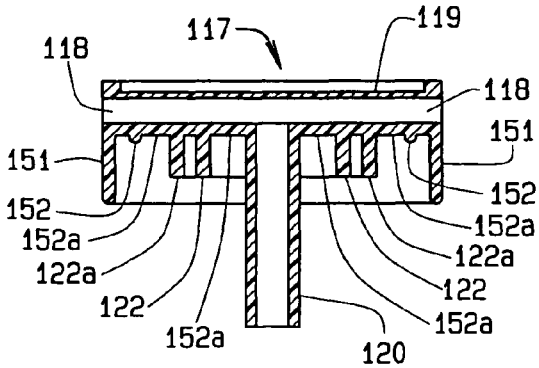
FIG. 39C shows another embodiment with two concentric flanges for placement of the reservoir.

Then another embodiment of the insert is shown in a section view in FIG. 39C. Like the other embodiments, the lateral vent has two opposed openings that communicate air between the bottle and the atmosphere. The insert 117 has a perimeter flange 151 here shown in two spaced apart sections, and two concentric minor lips 122 inner and 122*a* outer that receive the proximal end of the reservoir in a press fit between the two minor lips. The vent insert 117 has the perimeter flange at its lateral surface upon the perimeter of the insert. The perimeter flange is also a hollow cylindrical shape, perpendicular to the diameter of the insert and has an outer diameter that of the diameter of the vent insert. The vent insert seals tightly upon the exterior of the rim of the neck of the bottle as well as seals between the inferior bulge 152, or bead, of the insert and the top of the rim of the bottle, thus eliminating any leakage from the vent insert. As before, this embodiment allows the desired venting of air from the structure of the insert and its applicable usage in a nursing bottle. Inside of the perimeter flange upon the inferior surface 152*a* of the insert, a circular bulge, or bead, 152 has a lesser diameter than the perimeter flange and greater diameter than the outer minor lip 122*a*. The circular bulge 152 generally has the diameter of the neck of the bottle to form a second seal between the insert and the top edge of the neck to prevent leakage from within the bottle.

Depending from the inferior surface 152*a* of the vent insert 117, the vent insert has two concentric minor lips, 122, 122*a*. The minor lip 122 has a hollow cylindrical shape of greater diameter than the vent tube while the outer minor lip 122*a* has a hollow cylindrical shape of lesser diameter than the perimeter flange and more than the diameter of the inner minor lip 122. The proximal end of the reservoir fits snugly between the two minor lips in a press fit. The reservoir may be secured to the inferior surface 152*a* of the insert by locating between two lips or other means of joining. The minor lips seal the reservoir to the vent insert 117 outwardly of the internal vent tube 120.

The vent insert 117 has the distal insert or internal vent tube 120 centered upon the hole in the lateral vent 119, perpendicular to the lateral vent 119 within the insert wall 123, and coaxial with the reservoir. The internal vent tube 120 is a hollow cylinder of a length typically in excess of its diameter that communicates air, but not feeding liquid in the current invention, from the lateral vent 119 into the reservoir 126 of the vent tube 113.

Figure 40:
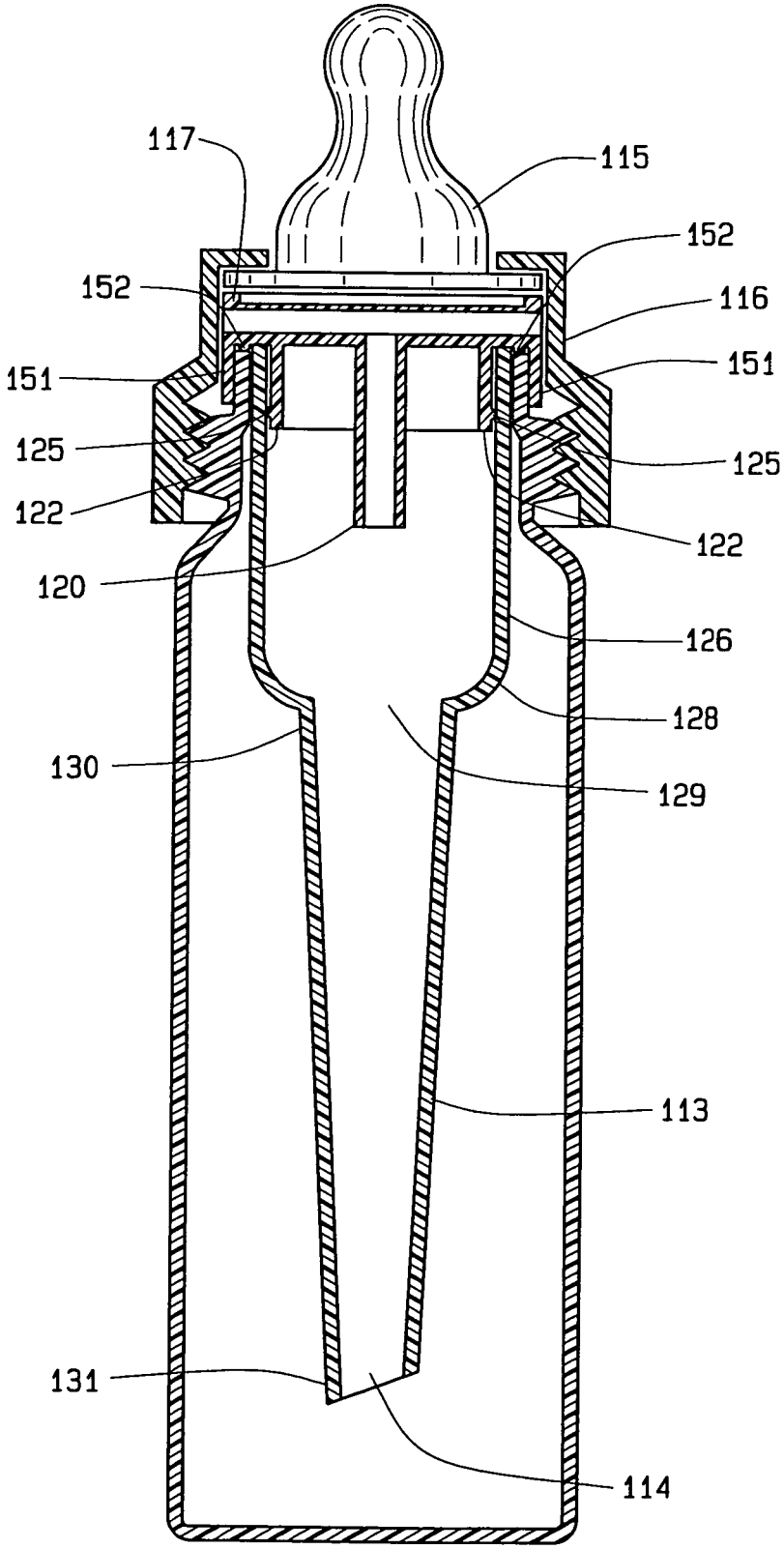
FIG. 40 is a sectional view of the reservoir of this invention tightly fitting within the neck of a bottle.

A bottle with an alternate embodiment of the insert of the present invention is shown assembled in FIG. 40 in a sectional view through the diameter of the bottle. As before, the bottle has a nipple 115 secured by a collar 116 upon the insert 117. The insert rests upon the top edge of the neck of the bottle. The perimeter flange 151 extends downwardly upon the outside of the neck, generally above the threads that engage the collar. Inside of the perimeter flange, the circular bulge 152 abuts the top edge of the neck and deforms upon turning the collar to seal the top edge of the neck to the insert and prevent leakage therefrom. As before, the vent tube 113 has a reservoir 126 having a generally hollow cylindrical shape with an open top 127, later shown in FIG. 42, and a partially closed bottom 128.

Opposite the top, the bottom 128 of the reservoir is smoothed and rounded as it descends distally from the insert. At the center of the bottom, an aperture 129 provides passage to the vent tube 113 joined to the bottom. The reservoir vent tube then attains a hollow truncated conical shape with the larger diameter 130 located towards the reservoir 126 and the narrow diameter 131 located distally. An aperture provides air to the bottom of the bottle, as at 114, for the vent tube, shown here in the preferred embodiment as conical though other shapes are possible. In addition, the bottom of the vent tube typically ends, in this instance, proximate to the internal bottom of any container upon which the venting structure of this invention applies, regardless of whether it be the standard bottle, a wide rim bottle, or the like.

A further alternate embodiment, similar to FIG. 40, includes an insert and reservoir connection where the minor lip 122 has a smooth perimeter while the reservoir has a bead, or bulge, upon its interior. The bead, similar to the bulge as at 125, provides a press fit of the reservoir's top 127 onto the minor lip 122. The minor lip, having an outer diameter that of the inner diameter of the top 127, then fits upon the reservoir by friction. As in the other embodiments, this alternate embodiment seals the reservoir to the insert and the insert rests upon the neck of the bottle.

Figure 41:
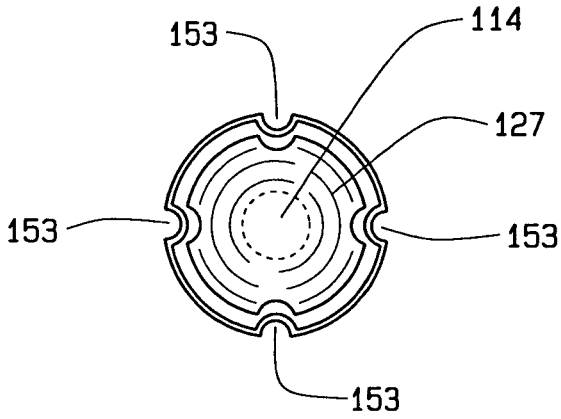
FIG. 41 is a top view of an alternate embodiment of the reservoir showing the flutes.

Turning to the reservoir 126 snugly installed in FIG. 40, FIG. 41 shows the top 127 viewed from above in an alternate embodiment of the invention. As the reservoir is attached to the inferior aspect of the insert and circumferential apertures 99, as earlier shown in FIG. 26, located in the medial aspect of the insert, the feeding liquid may pass the exterior of the reservoir and through the insert to the nipple for dispensing to an infant. While maintaining a tight fit to the neck, the reservoir permits passage of feeding liquid through at least one, and preferably four flutes as at 153. The flutes are regularly spaced upon the circumference of the reservoir. The flutes allow passage of liquid along the reservoir without infiltration of liquid into the reservoir through the wall of the reservoir. Caregivers are encouraged to align the flutes away from the lateral vent 119 so that feeding liquid may flow through all provided flutes. Each flute is generally a groove, or channel, extending lengthwise upon the reservoir from the top 127 downwardly. The channel may have various cross sections such as V shape, curved, elliptical, or partially circular as shown. The cross section of the channel in cooperation with the number of flutes permits passage of a sufficient volume of feeding liquid to satisfy an infant with a sucking reflex.

Figure 42:
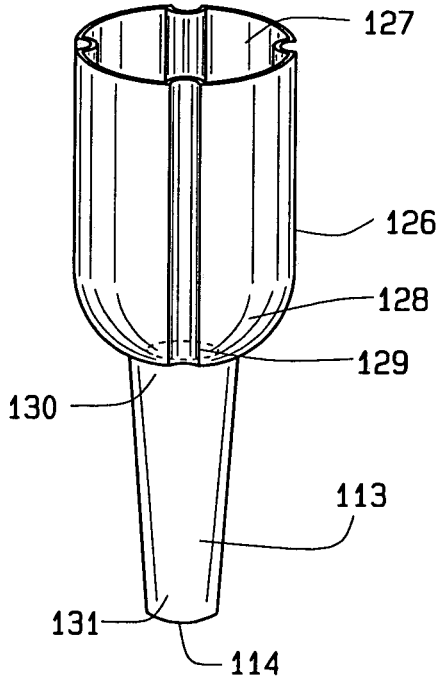
FIG. 42 is a side view of the alternate embodiment of the reservoir of this invention.

From the top 127, the flutes 153 descend to the bottom 128 of the reservoir portion of the contoured tube as in FIG. 42. Each flute follows the surface of the reservoir and attains a partially curved form proximate the bottom as the reservoir itself curves. In an alternate embodiment, the flutes extend down from the top for approximately the height of the perimeter flange.

Figure 43:
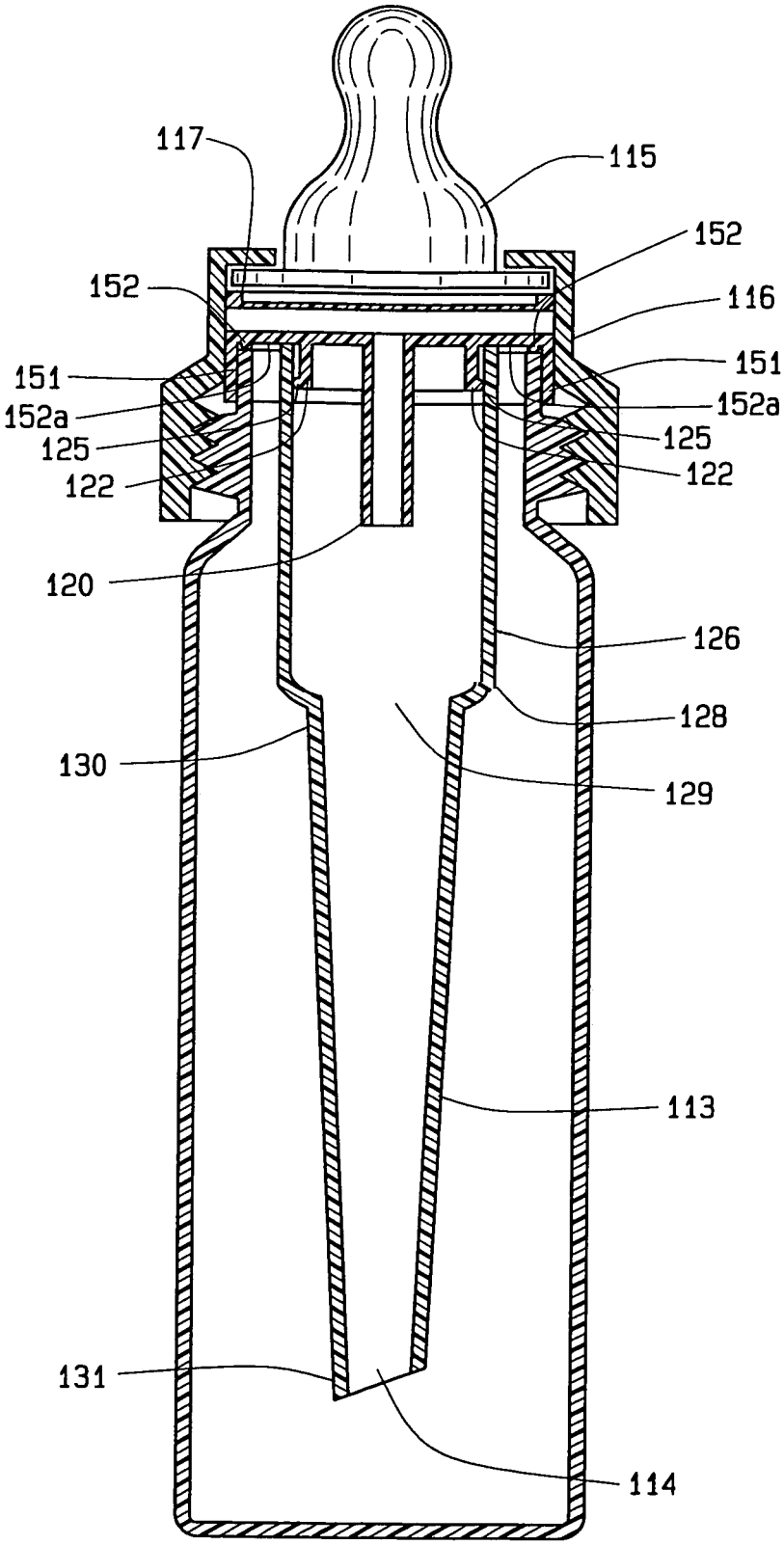
FIG. 43 is a sectional view of the reservoir of this invention with the gap laterally adjacent to the reservoir present for egress of fluid and with the reservoir located within the neck of a bottle, having a conically shaped venting tube, extended perimeter flange and location of at least one concentric flange that secures the reservoir to the inferior surface of the insert.

The preferred embodiment of the insert, reservoir, and bottle of the present invention is shown assembled in FIG. 43 in a sectional view through the diameter of the bottle. As before, the bottle has a nipple 115 secured by a collar 116 upon the insert 117. The insert rests upon the top edge of the neck of the bottle. The perimeter flange 151 extends downwardly and snugly upon the outside of the neck, generally above the threads that engage the collar. Inside of the perimeter flange, the circular bulge 152 upon the inferior surface 152*a* of the insert abuts the top edge of the neck. Upon turning the collar, the bulge 152 deforms to seal the top edge of the neck to the insert, and prevent leakage therefrom. As before, the vent tube 113 has a reservoir 126 having a generally hollow cylindrical shape with an open top 127 and a partially closed bottom 128.

Opposite the top, the bottom 128 of the reservoir is smoothed and rounded as it descends distally away from the insert. At the center of the bottom, an aperture 129 provides passage to the vent tube 113 joined to the bottom. The vent tube then attains a hollow truncated conical shape with the larger diameter 130 located towards the reservoir 126 and the narrow diameter 131 located distally. An aperture provides admission of air into the distal end of the vent tube, as at 114, shown here as conical. Additionally, the bottom of the vent tube typically ends, proximate to the internal bottom of any container upon which the venting structure of this invention applies: a narrow neck bottle, a standard bottle, a wide rim bottle, and the like.

The preferred embodiment here shown uses the vent insert connection to the reservoir of FIG. 39B. As before, the lateral vent typically has two opposed openings 118 for communicating air between the bottle and the atmosphere. The insert 117 has a perimeter flange 151 here shown in two spaced apart sections, and one concentric minor lip 122 depending from the inferior surface 152*a* of the insert. The minor lip is then press fitted onto the reservoir by the caregiver. The vent insert 117 has the perimeter flange of a hollow cylindrical shape, generally perpendicular to the diameter of the insert. The perimeter flange then has an inner diameter slightly less than that of the outer diameter of the neck of the bottle. Often over time, a bottle may become nicked at the rim of the neck. The nicks may lead to overflow of feeding liquid from inside the bottle and beneath the insert. The perimeter flange 151 provides a further seal to stop leakage from nicks upon the neck of the bottle.

Inwardly of the perimeter flange, the insert has a circular bulge 152 of lesser diameter than the perimeter flange, greater diameter than the minor lip 122, and generally the diameter of the neck of the bottle. Thus, the vent insert can be applied in a tight seal upon the exterior of the neck of the bottle and a seal formed between the inferior bulge 152 and the top of the neck of the bottle, thereby reducing leakage from the vent insert using two seals. This arrangement allows air venting from the insert during usage as a nursing bottle.

Depending from the lateral vent 119 on the inferior surface 152*a* of the vent insert 117, one minor lip 122 has a hollow cylindrical shape of lesser diameter than the perimeter flange for securing the insert to the reservoir. The minor lip has lesser height than the perimeter flange 151 but sufficient height for a secure press fit within the proximal end of the reservoir. The height of the minor lip allows the proximal end of the reservoir to resist detaching from the minor lip as the reservoir is jostled by feeding liquid during movement of the bottle. The reservoir secures to the inferior surface 152*a* of the insert by approximating the medial or lateral surface of a single inferiorly directed lip. The minor lip seals the reservoir to the vent insert 117 outwardly of the internal vent tube 120. The reservoir primarily seals to the insert and does not seal to the bottle, particularly within the neck.

As before, the vent insert 117 has an internal vent tube 120 centered upon and perpendicular to the lateral vent 119 within the insert wall, and coaxial with the vent tube 113. The internal vent tube 120, a hollow cylinder with a length greater than its diameter, communicates air, but not feeding liquid from the lateral vent 119 into the reservoir 126.

Figure 44:
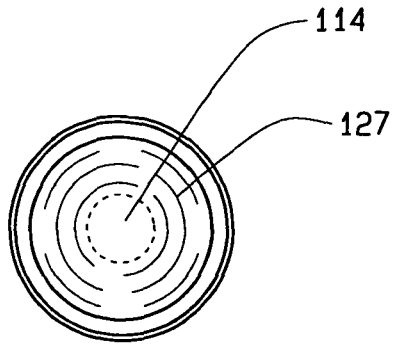
FIG. 44 is a top view of the reservoir of this invention showing a cylindrical exterior surface; and, FIG. 45 is a side view of the reservoir of this invention.

FIG. 44 shows a top view of the proximal end of the reservoir that cooperates with the minor lip 122 of FIG. 43. This end of the reservoir press fits upon the minor lip for ready attachment of the reservoir to the insert during assembly of the bottle by a caregiver. The inside diameter of the proximal end of the reservoir is similar to the outside diameter of the minor lip which has a bulge with a diameter larger than the inner diameter of the reservoir forming a pressed fit between the inside diameter of the reservoir and the minor lip 122 of the insert.

Figure 45:
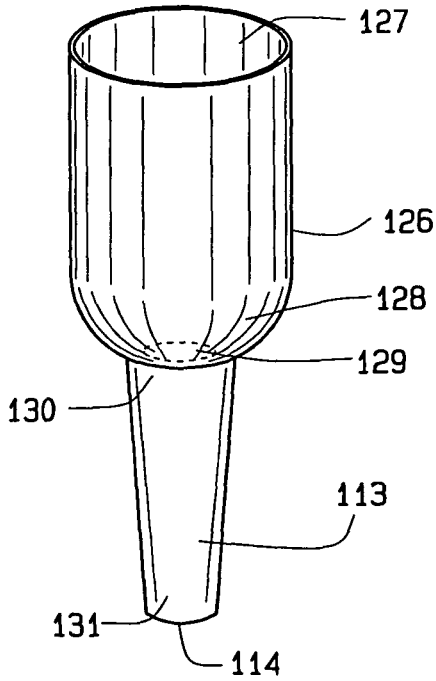

FIG. 45 shows the side view of the vent tube 113 used in the preferred embodiment where the reservoir press fits upon one minor lip upon the inferior surface 152*a* of the insert as previously shown in FIG. 43. This vent tube has a reservoir 126 with a depending vent tube 113 of conical shape. The conical shape provides a larger diameter 130, approximately 2-3 times larger than the width of the narrow diameter 131. Towards the narrow diameter 131, the vent tube 113 tapers distally as before. In this embodiment, the large diameter 130 is greater than the narrow diameter 131 in a ratio of approximately 4:1 to 1:1, with the preferred ratio of approximately 3:1.

Having described the components and arrangement of them, the present invention is used by an infant in cooperation with a caregiver. With the container in a feeding position, raised to an angle above the horizontal, venting air flows through the threads of the neck and into the horizontal aperture, through the internal vent tube, down into the reservoir, and then into the adjoining conical venting tube where it exits at the bottom of the container. The entrance of air through the venting tube eliminates the formation of a vacuum within the container and its associated adverse transfer into an infant's oral cavity and associated structures.

The venting mechanism of the present invention permits an uninterrupted flow of air into the container, thereby eliminating any vacuum formation in the container. This airflow occurs without mixing any air into the feeding liquid or without any feeding liquid escaping, that is leaking, from the container. Additionally, when the container is held in an inverted feeding position, the feeding liquid now flows through the openings in the insert portion between the annular edge and the rib, and then into the nipple or other liquid dispensing attachment. Furthermore, the liquid in the tapering venting tube flows quickly and gently into the reservoir. The liquid becomes trapped within the reservoir below the volumetric center and the inferior end of the venting tube of the insert. Any air that remains in the venting system readily enters into the container bottom similar to the air entering the venting mechanism through the neck of the container.

When the container is returned to a vertical position, as when the neck is deviated upwardly, the liquid trapped in the reservoir now flows down into the venting tube to pool with the remaining liquid in the container, again, without mixing air into the liquid or liquid leaking from the container. In the preferred embodiment of the venting tube, the superior end of the conical venting tube increases the effective volume of the reservoir.

Returning to an inverted, or feeding, position, the tapered embodiment of the venting tube allows liquid to flow quickly and easily into the reservoir and allows air initially within the reservoir to quickly enter the bottom space of the container. In a vertical position, the tapered venting tube increases the overall volume capacity of the reservoir.

First, the reservoir, with its conical venting tube, reduces the force of the liquid approaching the vent tube of the insert portion. Second, the preferred embodiment of the conical venting tube allows the feeding liquid therein to move more quickly and easily into the reservoir. During such movement, the air in the conical venting tube more easily exits to the inferior, or bottom of the bottle. Third, the reservoir increases its effective volume as the taper of the preferred embodiment of the venting tube temporarily stores feeding liquid. Fourth, in the alternate embodiment, the flutes upon the reservoir allow movement of the feeding liquid from the bottle and past the insert with vented air replacing the volume of feeding liquid consumed by an infant.

These mechanisms allow for complete and continuous venting of the container at all times without contamination of the liquid with air and also prevents any leakage. The container accommodates the liquid that remains in different parts of the venting mechanism at different times during usage. These mechanisms allow the present invention to function as a vent and accommodate fluid, separate air and fluid at all times, and prevent leaks from the container when in any position.

From the aforementioned description, a fully vented wide rim, or other diameter, nursing bottle has been described with a conical venting tube, an insert utilizing at least one flange to secure the reservoir to the insert by preferably a press fit or alternatively by mechanical, chemical, or other means to a non-flanged insert to allow usage of less expensive materials, to permit disposal or reuse of the invention, with a laterally placed insert flange to form a press fit with the outside diameter of the lateral aspect of the neck of the bottle. This nursing bottle is uniquely capable of eliminating negative pressure continuously and automatically in a bottle or container. This nursing bottle and its various components may be manufactured from many different materials including but not limited to polymers, low density polyethylene, high density polyethylene, polypropylene, polycarbonate, PES, glass, nylon, ferrous and non-ferrous metals, their alloys, silicone, and composites. For an example, the feeding container may be made of polypropylene, polyethylene, or other suitable material. And, the collar for fastening the nipple upon the feeding container may be made of polyethylene, polypropylene, or other material, and the adjacent feeding nipple is preferably made of silicone, or another material.

Variations or modifications to the subject matter of this invention may occur to those skilled in the art upon reviewing the development as described herein. Such variations, if within the scope of this development, are intended to be encompassed within the principles of this invention, as explained herein. The descriptions of the preferred embodiment, in addition to the depiction within the drawings, are set forth for illustrative purposes only.

We claim:

1. A nursing bottle assembly having a container with a closed bottom end, a top end opposite said bottom end and having an opening therein for receiving liquid into an interior of the container, a neck at the top end with an inner diameter defining the size of the opening at the top end, a nipple, and a threaded collar sealing between said nipple and said neck while allowing liquid to flow from said container to said nipple, and to provide closure for the opening at the top end, wherein the improvement comprises:

a vent unit having an insert with an integral vent tube and a reservoir with a reservoir tube;

said insert generally providing venting to said bottle assembly while resting upon said neck, having an integral insert portion, said integral vent tube depending from the center of said insert portion, said reservoir depending from the center of said insert portion with said vent tube locating within said reservoir, and said reservoir tube in communication with said reservoir and depending from said reservoir;

said insert having a horizontal aperture along its diameter;

said insert portion sealing to said top end, having a perimeter sealing flange extending downwardly and inwardly adjacent to said neck and a horizontal aperture therethrough for communicating with the interior of said container, an inferior surface, and a sealing bulge depending from said inferior surface and resting upon said neck of said bottle when assembled;

said vent tube being in communication with said horizontal aperture; and, said reservoir depending from the inferior surface of said insert;

said reservoir tube being generally hollow, said reservoir tube having a distal end disposed proximate to the bottom of said container and being open to the interior of the container to facilitate venting;

wherein said horizontal aperture of said insert, said vent tube of said insert, said reservoir, and said reservoir venting tube cooperate for continuous venting of said assembly without introduction of air into the liquid and without creation of vacuum in said assembly;

said reservoir having a generally hollow cylindrical shape with an upper end joined below said insert portion and an opposite lower end joining to said reservoir tube;

said venting tube of said insert having a length generally more than its diameter and a distal end, and being generally perpendicular to said insert portion;

an inner space of said reservoir having a volumetric capacity and a volumetric center, and said distal end of said vent of said insert generally opening near the volumetric center of said reservoir;

said venting tube having a length greater than its diameter;

said insert having two concentric spaced apart minor flanges integrally extending downwardly therefrom, said minor flanges receiving the upper end of said reservoir in a sealing press fit therebetween; and wherein said insert seals to the said nursing bottle, and holds the upper end of the reservoir between its concentric spaced apart minor flanges during usage of the nursing bottle assembly.

2. The nursing bottle assembly of claim 1 further comprising:

said reservoir tube having a conical shape with a larger diameter proximally towards said reservoir and a narrow diameter distally.

3. The container for dispensing fluids of claim 1 further comprising:

said reservoir having a cylindrical shape, an upper end joined to said insert portion, and a lower end in communication with said reservoir tube;

an inner space of said reservoir having a volumetric capacity and a volumetric center; and, said vent having a length approximately half that of said reservoir and the end of said vent being disposed generally near the volumetric center of said reservoir.

4. The container for dispensing fluids of claim 3 further comprising:

said reservoir tube having a conical shape, a larger diameter proximally and a narrow diameter distally and disposed generally near the bottom of said container and being open to the inner space of said container.

5. The container for dispensing fluids of claim 1 further comprising:

said inferior surface of said insert being flat; and, said reservoir joining to said inferior surface of said insert.

6. The container for dispensing fluids of claim 1 wherein the materials of construction allow for reuse of said container.

* * * * *